US005388836A

United States Patent [19]

Foti

[11] Patent Number: 5,388,836

[45] Date of Patent: Feb. 14, 1995

[54] BOARD GAME OF INTERNATIONAL FINANCE

[76] Inventor: Dino A. Foti, 46 Waterloo Ct., Belmont, Calif. 94002

[21] Appl. No.: 268,492

[22] Filed: Jun. 30, 1994

[51] Int. Cl.[6] ..... A63F 3/00

[52] U.S. Cl. ..... 273/256

[58] Field of Search ..... 273/242, 243, 251, 252, 273/254, 256, 278

[56] References Cited

U.S. PATENT DOCUMENTS

| | | | |
|---|---|---|---|
| 3,756,604 | 9/1973 | Laszlo . | |
| 3,914,889 | 10/1975 | Wagner . | |
| 3,949,991 | 4/1976 | Chase | 273/256 |
| 4,266,775 | 5/1981 | Chitnis et al. . | |
| 4,445,692 | 5/1984 | Boyle . | |
| 4,456,259 | 6/1984 | Antal et al. . | |
| 4,538,816 | 9/1985 | Figueroa | 273/256 |
| 4,629,195 | 12/1986 | Charney | 273/256 X |
| 4,856,788 | 8/1989 | Fischel . | |
| 4,928,967 | 5/1990 | Woodliff | 273/256 X |
| 4,934,707 | 6/1990 | Koster . | |
| 5,013,048 | 5/1991 | Turner | 273/256 X |
| 5,131,663 | 7/1992 | Klein . | |
| 5,322,294 | 6/1994 | Landfield | 273/256 X |

FOREIGN PATENT DOCUMENTS

| | | | |
|---|---|---|---|
| 2078118 | 1/1982 | United Kingdom . | |
| 2163665 | 3/1986 | United Kingdom | 273/256 |
| 2234181 | 1/1991 | United Kingdom . | |
| 2236059 | 3/1991 | United Kingdom . | |
| 2237216 | 5/1991 | United Kingdom . | |
| 8809690 | 12/1988 | WIPO . | |

OTHER PUBLICATIONS

Geico Direct, Fall 1988 issue, pp. 32-33-"Monopoly" Article.

*Primary Examiner*—William E. Stoll

*Attorney, Agent, or Firm*—Richard C. Litman

[57] ABSTRACT

A board game of international finance simulates travel and financial exchanges between participants in two or more nations. The game includes travel about a playing path generally along the periphery of the board and the simulated purchase by the players of various properties or cities in each nation. The owners of the properties or cities may collect taxes from other players who land on the owners' properties. Numerically uneven currency exchange rates enter into the play of the game and are randomly variable, according to the draw of cards during the game. In one embodiment, two nations are represented, and in another more advanced embodiment, four nations are represented, as well as additional features such as stocks and bonds. The game provides a somewhat realistic simulation of current international financial dealings.

8 Claims, 12 Drawing Sheets

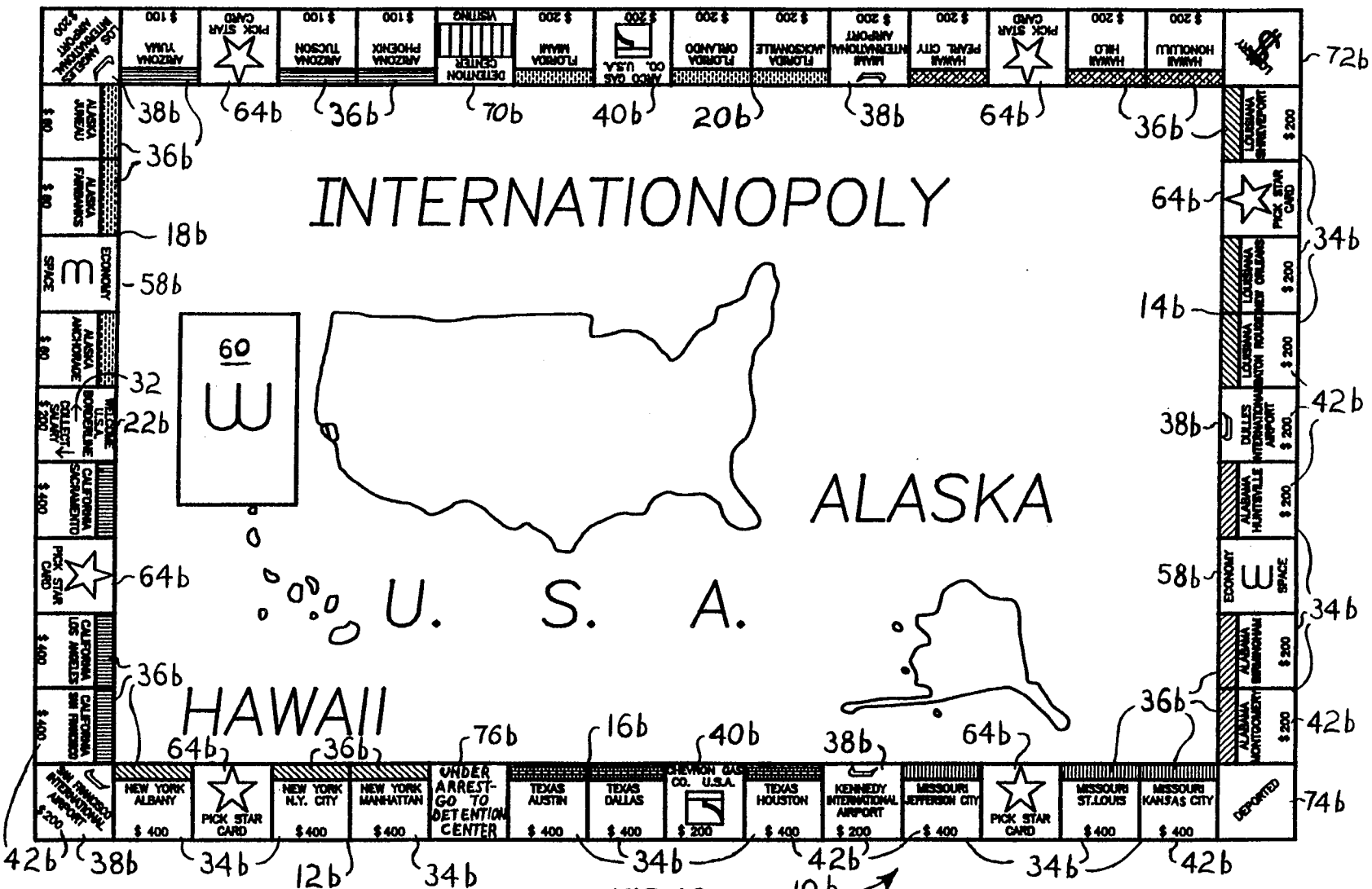
INTERNATIONOPOLY
ALASKA
U. S. A.
HAWAII
GO
ALASKA JUNEAU $60
ALASKA FAIRBANKS $60
ECONOMY SPACE
ALASKA ANCHORAGE $60
WELCOME U.S.A. BORDERLINE COLLECT SALARY $200
CALIFORNIA SACRAMENTO $400
PICK STAR CARD
CALIFORNIA LOS ANGELES $400
CALIFORNIA SAN FRANCISCO $400
SAN FRANCISCO INTERNATIONAL AIRPORT $200
NEW YORK ALBANY $400
PICK STAR CARD
NEW YORK N.Y. CITY $400
NEW YORK MANHATTAN $400
UNDER ARREST-GO TO DETENTION CENTER
TEXAS AUSTIN $400
TEXAS DALLAS $400
CHEVRON OIL CO. U.S.A. $200
TEXAS HOUSTON $400
KENNEDY INTERNATIONAL AIRPORT $200
MISSOURI JEFFERSON CITY $400
PICK STAR CARD
MISSOURI ST.LOUIS $400
MISSOURI KANSAS CITY $400
DEPORTED
ALABAMA MONTGOMERY $200
ALABAMA BIRMINGHAM $200
ECONOMY SPACE
ALABAMA HUNTSVILLE $200
DULLES INTERNATIONAL AIRPORT $200
LOUISIANA NEW ORLEANS $200
LOUISIANA BATON ROUGE $200
PICK STAR CARD
LOUISIANA SHREVEPORT $200
HAWAII HONOLULU $200
HAWAII HILO $200
PICK STAR CARD
HAWAII PEARL CITY $200
MIAMI INTERNATIONAL AIRPORT $200
FLORIDA JACKSONVILLE $200
FLORIDA ORLANDO $200
CHEVRON OIL CO. U.S.A. $200
FLORIDA MIAMI $200
DETENTION CENTER
ONLY VISITING
ARIZONA PHOENIX $100
ARIZONA TUCSON $100
PICK STAR CARD
ARIZONA YUMA $100
LOS ANGELES INTERNATIONAL AIRPORT $200
10b
12b
14b
16b
18b
20b
22b
32
34b
36b
38b
40b
42b
58b
64b
70b
72b
74b
76b
FIG. 1B

BOARD GAME OF INTERNATIONAL FINANCE

FIELD OF THE INVENTION

The present invention relates generally to board games, and more specifically to a board game involving simulated travel and financial exchanges between participants of two or more nations. Currency exchange rates and other factors enter into the play of the game.

BACKGROUND OF THE INVENTION

In current times, people are generally provided with increasing amounts of leisure time to pursue various hobbies and leisure activities, such as board games and the like. In many cases, the players of such games wish to be intellectually stimulated and challenged in an enjoyable way, hence the popularity of trivia games and the like testing the knowledge of the players. Further, the players of such games tend to become interested in various specialties, either related to their work or to another interest.

In some cases, those special interests lie in the financial field, and accordingly games have been developed to respond to those interests (e.g., Monopoly, tm). However, such games as Monopoly are based upon a relatively localized area, and do not take into account the additional complexities found in international finance, such as travel and different currency exchange rates. Accordingly, such games are somewhat dated in their simulation of the modern world financial situation and fail to provide any education for the players in such international financial matters.

The need arises for a board game of international finance incorporating various financial activities, such as the buying and selling of properties and the taxation of such properties, as well as other factors such as travel and variable international currency exchange rates. A relatively simple first embodiment may include only two different nations and a variable currency exchange rate between the two, while a second embodiment of the present game may include four different nations and other factors (e.g., stocks and bonds) besides the currency exchange rates between nations. In either case, the game should provide additional knowledge and skill for the players in understanding the modern, relatively complex international financial situation.

DESCRIPTION OF THE PRIOR ART

U.S. Pat. No. 3,756,604 issued to Alexander L. Laszlo on Sep. 4, 1973 discloses a Political Science Board Game Construction having a game board with an endless circular playing path including representations of regions of the world and instructions representing international discussions and messages, as well as military action. Simulated currency is provided as an exchange medium, but no different currency is provided for different nations, as in the present game, nor are any variable exchange rates provided. The Laszlo game is primarily directed to a simulation of an international power struggle, rather than to international financial matters, as in the present game. Moreover, the present game includes a limited number of representative nations, in keeping with the intricacies of the game providing realism.

U.S. Pat. No. 3,914,889 issued to John S. Wagner on Oct. 28, 1975 discloses a Wallet-Type Display Of Relative Currency Values comprising a folder with two relatively slidable strips therein which strips include currency values thereon and which may be aligned with one another to provide an indication of exchange rates between the two currencies. The device has no relationship to the present game, as the currency exchange rates of the present game are determined by the rules of the game and/or in accordance with the random drawing of cards during the game to change the rates.

U.S. Pat. No. 4,266,775 issued to Raveendra V. Chitnis et al. on May 12, 1981 discloses a Game Involving The Dealing In Commodities involving several different chance means, representations of numerous nations or regions of the world, and several commodity exchanges. No multiple currencies or variable exchange rates therebetween are provided by Chitnis et al. in their game, whereas the present board game provides for such for added realism, but limits the number of nations represented in order to avoid an exceedingly complex game.

U.S. Pat. No. 4,445,692 issued to Walter G. Boyle on May 1, 1984 discloses a Board Game Involving International Trade in which numerous nations of the world, and typical products or materials therefrom, are represented. While simulated currency is a part of the game, again only a single simulated currency is provided with no exchange rates to add realism, as in the present game. Again, the present game limits the number of nations represented in order to provide further realism in the transactions of the game.

U.S. Pat. No. 4,456,259 issued to Leonard L. Antal et al. on Jun. 26, 1984 discloses a Board Game including variable exchange rates between different simulated currencies. However, the nominal exchange rate is unrealistic, being a one-to-one ratio, unlike the realistic rates of the present game. Rather than attempting to acquire all of the properties of any one type, as in the present game, the goal of the Antal et al. game is to acquire only a single property in each of four zones. Non-sequential play is provided, in which a playing piece is advanced from off the board to a position of the player's choice on the board, depending upon the play, unlike the present game.

U.S. Pat. No. 4,856,788 issued to Mario Fischel on Aug. 15, 1989 discloses a Method Of Playing A Game Of Economics And Finance providing numerous options resulting in an exceedingly complex game. No simulation of movement between different nations is provided, and while investment in foreign currency futures is provided, only a single simulated currency is provided and thus no different exchanges can be made during the course of play, as in the present game.

U.S. Pat. No. 4,934,707 issued to John S. Koster on Jun. 19, 1990 discloses a Stock Market Board Game having six identical sets of playing spaces in a hexagonal array, with one set for each of up to six players. No simulation of international interests is disclosed, and the only simulated purchases are of stocks, unlike the cities of various nations provided by the present game. A scoresheet is provided to keep a record of the simulated stock prices during the game, which totals at the end of the game determine the winner; the present game considers only the simulated currencies of various nations and their values.

U.S. Pat. No. 5,131,663 issued to David Klein on Jul. 21, 1992 discloses a Board Game With Two Playing Areas, in which only certain types of actions may be taken according to the specific area of the board in which a player's position marker is situated. Virtually the only similarity between the Klein game and the present game is the use of two playing areas in one embodiment of the present game.

British Patent No. 2,078,118 to Paul J. Mason and published on Jun. 6, 1982 discloses a Trading Game involving multiple paths of play over a map of the world with numerous nations represented thereon. Only one simulated currency is provided, and thus no exchange rates, variable or fixed, are provided by Mason. Only commodities may be acquired in the Mason game; other properties are not available, as in the present game.

British Patent No. 2,234,181 to Barry Howard and published on Jan. 30, 1981 discloses a Board Game having a hexagonal array of playing spaces with instructions thereon. Only the buying and selling of simulated stocks with a single simulated currency is permitted; other types of properties and other currencies, along with their fixed or variable exchange rates, are not disclosed by Howard.

British Patent No. 2,236,059 to Reda B. Bouabdallah et al. and published on Mar. 27, 1991 discloses an Apparatus For Playing A Game having a representation of the European Economic Community thereon. The game is played by making simulated investments in various economic sectors as defined by the board. No specific playing path is disclosed, and only a single currency unit (the European Currency Unit) is disclosed, thus obviating any exchange rates, either fixed or variable, as in the present game.

British Patent No. 2,237,216 to Jatinder K. Singh and published on Jan. 5, 1991 discloses a Board Game having a rectangular board and a representation of a single nation thereon, unlike the plural nations of the present game. Cards are drawn as the game progresses, with the cards representing typical tourism activities and purchases. The cards and game represent actual commercial and civic establishments, and thus the game might be considered more a form of advertising. No multiple currencies or exchange rates therefor are disclosed.

International Patent No. 88/09690 to Jonathan Durr and published on Dec. 15, 1988 discloses an Apparatus For Playing Board Games relating to the simulated purchase of residential properties and the costs involved therewith. Variables are provided in the form of changes in property values due to various circumstances, but no simulated international play or multiple currencies are provided, as in the present game.

Finally, an article on the game of Monopoly in the fall, 1988 issue of GEICO Direct, pp. 32 and 33, discloses various facts relating to the development and history of the game. In a sidebar entitled "Monopoly Mania" on p. 33, an improvised game including four Monopoly game boards from different nations is disclosed, wherein the transactions were conducted using the currency and language of the nation of the each given game board. No means for currency exchange is disclosed in the article, or is any variation in exchange rate disclosed, as in the present game.

None of the above noted patents, taken either singly or in combination, are seen to disclose the specific arrangement of concepts disclosed by the present invention.

SUMMARY OF THE INVENTION

By the present invention, an improved board game of international finance is disclosed.

Accordingly, one of the objects of the present invention is to provide an improved board game of international finance which utilizes two adjacent playing paths on at least one board, with each path representing options and play based upon the economy of a different nation, with the players moving from one playing path to another during the course of play.

Another of the objects of the present invention is to provide an improved board game of international finance which uses two different simulated currencies, one for each of the nations represented.

Yet another of the objects of the present invention is to provide an improved board game of international finance in which the exchange rate for the different currencies is other than a one to one exchange, and which exchange rate is randomly variable during the course of play of the game.

Still another of the objects of the present invention is to provide an improved board game of international finance which simulates various financial transactions, such as the buying and selling of municipalities and corporations of different nations, and the taxing of players encountering those areas of the board.

A further object of the present invention is to provide an improved board game of international finance which, in a second embodiment, includes a single, generally peripheral path of play about a single board, but which path simulates travel to and from at least four different nations and which path is traveled by the players during the course of play.

An additional object of the present invention is to provide an improved board game of international finance which second embodiment provides simulated currencies for each of the nations of the game, with corresponding numerically uneven exchange rates which are randomly variable during the course of play.

Another object of the present invention is to provide an improved board game of international finance which second embodiment not only provides for the simulated buying and selling of properties, but also of stocks and "junk" bonds.

Yet another object of the present invention is to provide an improved board game of international finance which provides educational value in teaching players the fundamentals of international economics.

A final object of the present invention is to provide an improved board game of international finance for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 1B is a plan view of the second half of the above game board.

FIG. 10A is a view of the back of a typical "Gas Company" card used in the present game, identifying the gas company.

FIG. 10B is a view of the front or face of the "Gas Company" card of FIG. 10A, showing the rates to be paid by a player landing upon that playing space to the player-owner thereof and the borrowing capacity for the player-owner.

FIG. 11A is a view of the back of a typical "International Airport" card used in the present game, identifying the airport.

FIG. 11B is a view of the front or face of the "International Airport" card of FIG. 11A, showing the fees to be paid by a player landing upon that playing space to the player-owner thereof and the borrowing capacity for the player-owner.

FIG. 221B is a view of the front or face of the "Bond" card of FIG. 21A, showing the value of the bond.

Similar reference characters denote corresponding features consistently throughout the figures of the attached drawings.

DETAILED DESCRIPTION OF THE PREFERRED EMBODIMENTS

Figure 1A:
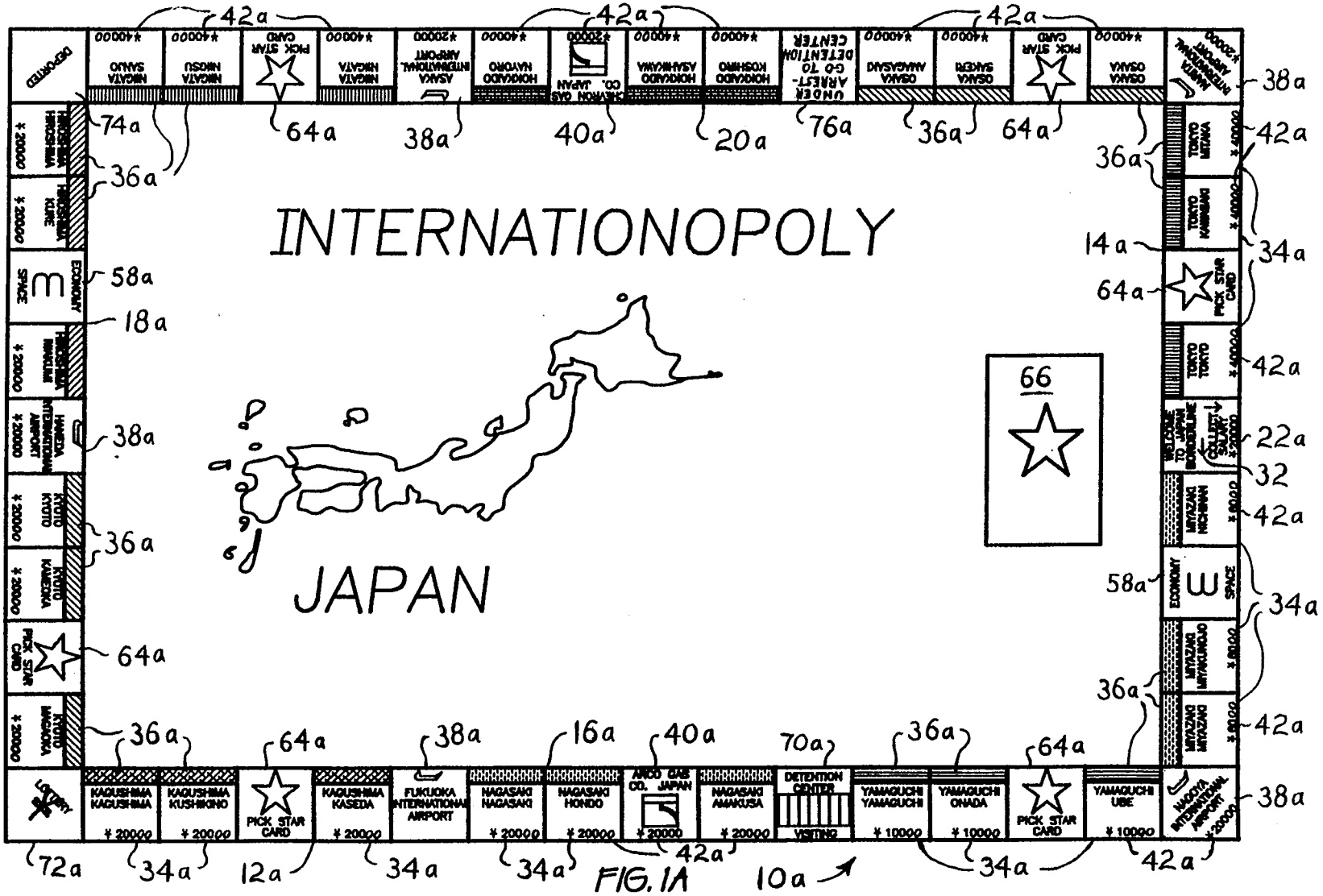
FIG. 1A is a plan view of one half of the game board of the present game apparatus, showing its various features.

Referring now particularly to FIGS. 1A and 1B of the drawings, the present invention will be seen to relate to an apparatus for a board game of international finance including a game board or boards **10*a* (FIG. 1A) and 10*b* (FIG. 1B). Board(s) 10*a* and 10*b* each include a generally rectangular peripheral playing path 12*a* and 12*b*, with each playing path having first through fourth sides 14a through 20a and 14b through 20b** respectively and comprising a plurality of playing positions.

Each board 10a and 10b includes a "borderline," i.e., port of entry position respectively 22a and 22b, which positions provide for passage from one board to the other during the course of play. The border position 22b for the U.S. board 10b is in the center of the left side 18b, while the border position 22a for the Japanese board 10a is in the center of the right side 14a. (It will be understood that any two nations may be represented on the two boards 10a and 10b, and need not be limited to representations of the U.S. and Japan.)

When the two boards 10a and 10b are properly positioned for play of the present game, the left side 18b of the U.S. board 10b and the right side 14a of the Japanese board 10a are immediately adjacent one another, with the two border or port of entry positions 22a and 22b also positioned immediately adjacent one another to provide for travel from one board to the other during play. While the game boards 10a and 10b are shown on two separate drawing sheets for clarity, it will be understood that they may be combined as a single game board if desired, with folding means along the common edge between the two halves 10a and 10b.

Figure 2:
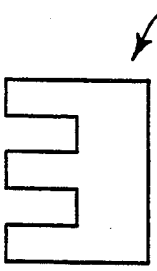
FIG. 2 is a view of a player position marker used in the present game.

FIG. 2 discloses the configuration of a player position marker 24 used in the play of the present game. One marker 24 is provided for each player of the present game, with each player's marker being of a different color. Alternatively, markers having a different configuration(s) may be used, if desired. Markers 24 are used to designate the position of each player of the game along the playing paths 12a and 12b of the board(s) 10a and 10b. As noted above, the rules of the present game provide for movement of the player position markers 24 from one board to another, across the adjoining border positions 22a and 22b.

Figure 5:
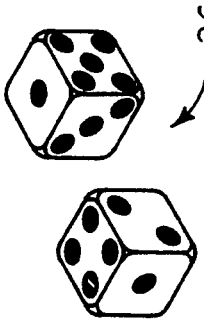
FIG. 5 is a perspective view of the standard dice used as the chance means for the present game.

FIG. 5 discloses the chance means used for the determination of player movement and other factors during the course of play of the present game. Conventional dice 26 are preferably used, with each die comprising a cube with each of the six sides of each cube respectively having a number or other representation from one through six marked thereon. Alternatively, other chance means (e.g., spinner or wheel, etc.) may be used if desired.

The object of the present game is to acquire the greatest amount of simulated wealth during the course of the game. The game is preferably played to a time limit, with the player accruing the greatest simulated wealth being the winner. Alternative end game limits may be used if desired, e.g., playing until no more simulated currency is held by the "bank" and all such currency is in the hands of the players; playing until all possible purchases on the board have been made by the players; etc. Accordingly, each player is issued equal amounts of simulated currency for the nations represented on the board (e.g., yen and U.S. dollars) before beginning play. The simulated currency provided for each player starting the game is as follows:

| U.S. DOLLARS | YEN |
|---|---|
| 2 - $500 | 2 - Y50,000 |
| 2 - $100 | 3 - Y10,000 |
| 2 - $50 | 2 - Y5,000 |
| 6 - $20 | 5 - Y2,000 |
| 5 - $10 | |
| 5 - $5 | |
| 5 - $1 | |

-continued

| | U.S. DOLLARS | YEN |
|---|---|---|
| PLAYER TOTAL | $1,500 | Y150,000 |

Up to eight players may play the present game, thus requiring a total of $12,000 and Y1,200,000 in simulated currency. In addition, an equal "bank" or reserve for periodic payouts to players as they complete a cycle around the playing path of each board 10a and 10b, is preferably provided; the precise amount of simulated currency provided may be adjusted according to the values selected for the simulated fiscal transactions, the currencies simulated for each nation, and/or the number of players.

Figure 12A:
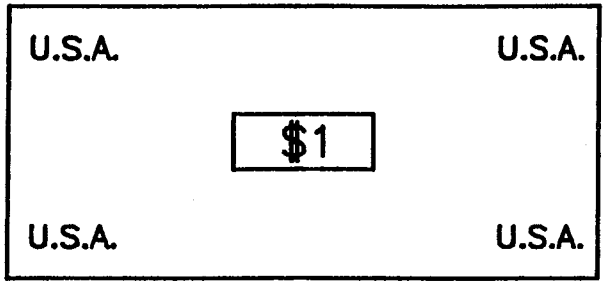
FIG. 12A is a view of one denomination of a first type of simulated currency used in the present game.
Figure 12C:
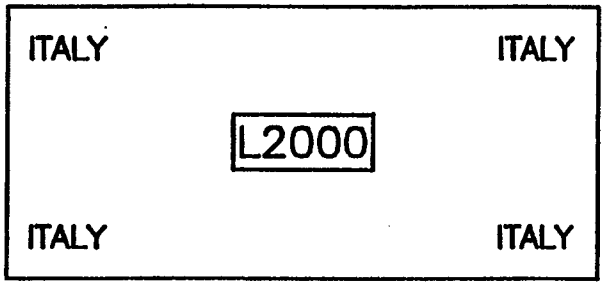
FIG. 12C is a view of one denomination of a third type of simulated currency used in the present game, in an alternate embodiment of the game.
Figure 12B:
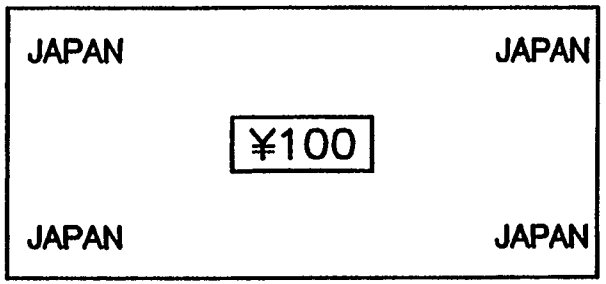
FIG. 12B is a view of one denomination of a second type of simulated currency used in the present game.
Figure 12D:
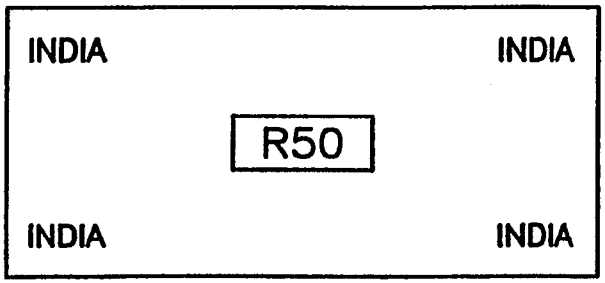
FIG. 12D is a view of one denomination of a fourth type of simulated currency used in the present game, in an alternate embodiment of the game.

FIGS. 12A and 12B disclose views respectively of a U.S. currency note 28 and a Japanese yen note 30. In order to add greater interest to the present game, the respective absolute values of the two simulated currencies 28 and 30 are different, with the U.S. currency 28 having a value of 100 times that of the Japanese currency 30, e.g., one U.S. dollar is equal to 100 Japanese yen. This is a reasonable approximation of the present actual exchange rate between the two currencies, and is selected in order to provide for ease of translation between the two currencies 28 and 30; the basic dollar/yen exchange ratio for the present game may be determined by shifting the decimal point to the left or right two positions, as appropriate.

The order of play is determined by tossing the dice 26, with the player having the highest total playing first and other players taking their turns in the order of the number tossed with the dice. Other means of determining the order of play may be used as desired. The first player then places his/her position marker 24 on one of the two point of entry positions 22a or 22b as desired; all players are required to begin play on that same position and board, following the lead of the first player. The first player tosses the dice 26 again, and moves his/her position marker along the peripheral playing path 12a or 12b, as appropriate, in the direction indicated by the arrows 32 in each of the border crossing positions 22a and 22b, proceeding clockwise about the chosen board 10a or 10b.

Each board 10a and 10b is essentially equivalent to its opposite member and contains a plurality of "Prefecture/City" positions 34a (on the Japanese board 10a) or "State/City" positions 34b (on the U.S. board 10b). Each group of prefecture/city positions 34a (or state/city positions 34b) is distinguished by color (as in the colored areas 36a and 36b respectively of the prefecture/city and state/city positions 34a and 34b) from other prefectures or states, in order for players to determine cities of like prefectures or states more readily. Other positions represent international airports 38a and 38b and gasoline companies 40a and 40b, respectively of boards 10a and 10b. Each of the above positions 34a, 34b, 38a, 38b, 40a, and 40b includes a price 42a or 42b in U.S. currency (on board 10b) or Japanese currency (on board 10a) which must be paid to the bank by a player first alighting on that position, if that player wishes to "purchase" and have control over that position during the course of play of the game.

Figure 9A:
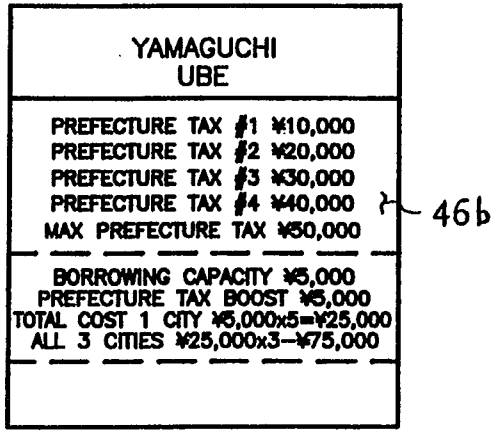
FIG. 9A is a view of the front or face of a typical Prefecture/City card used in the present game, showing the "tax rates" for a player landing on that playing space according to the tax tokens purchased by the player-owner, and the cost of acquiring tax tokens for that Prefecture/city.
Figure 9B:
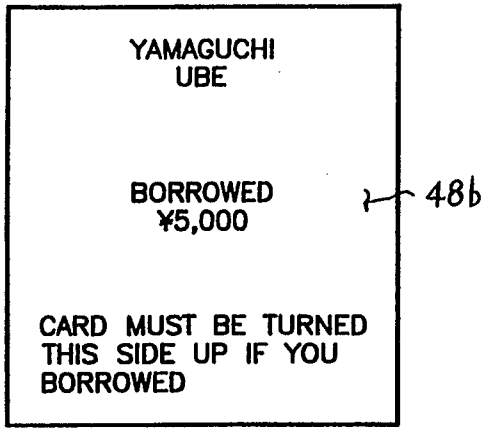
FIG. 9B is a view of the back of the Prefecture/City card of FIG. 9A, identifying the prefecture/city and the borrowing capacity for a player-owner of that state/-city.
Figure 8A:
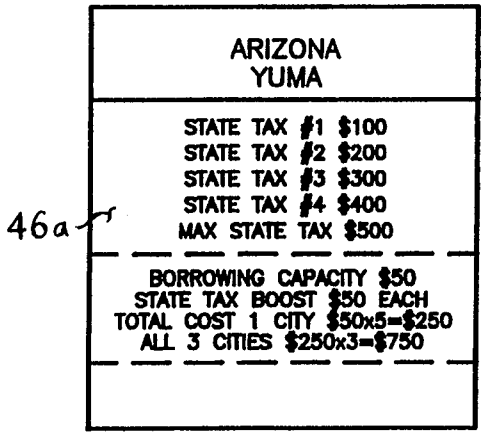
FIG. 8A is a view of the front or face of a typical State/City card used in the present game, showing the "tax rates" for a player landing on that playing space according to the tax tokens purchased by the player-owner, and the cost of acquiring tax tokens for that state/city.
Figure 8B:
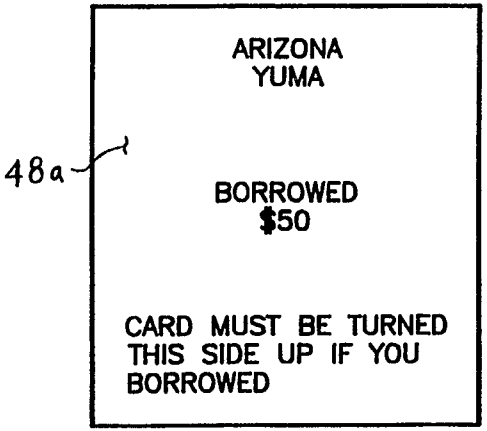
FIG. 8B is a view of the back of the State/City card of FIG. 8A, identifying the state/city and the borrowing capacity for a player-owner of that state/city.
Figure 8:
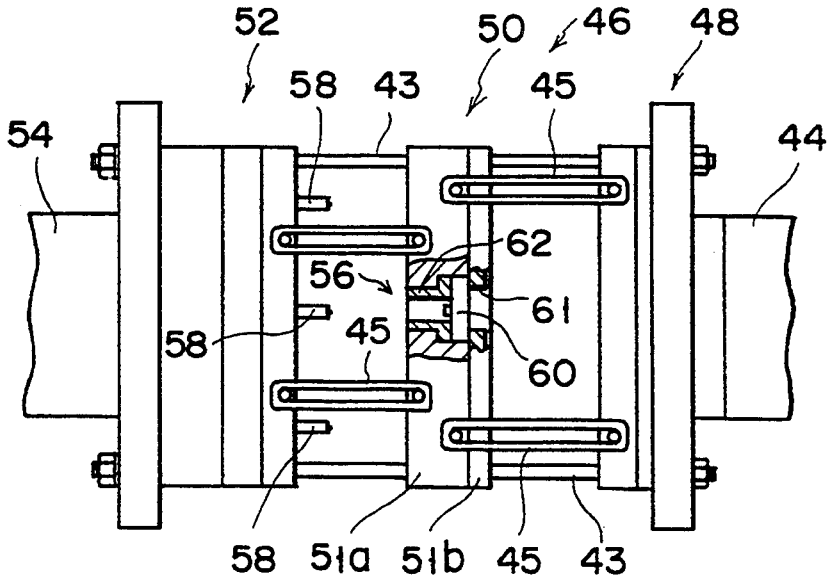
Figure 9:
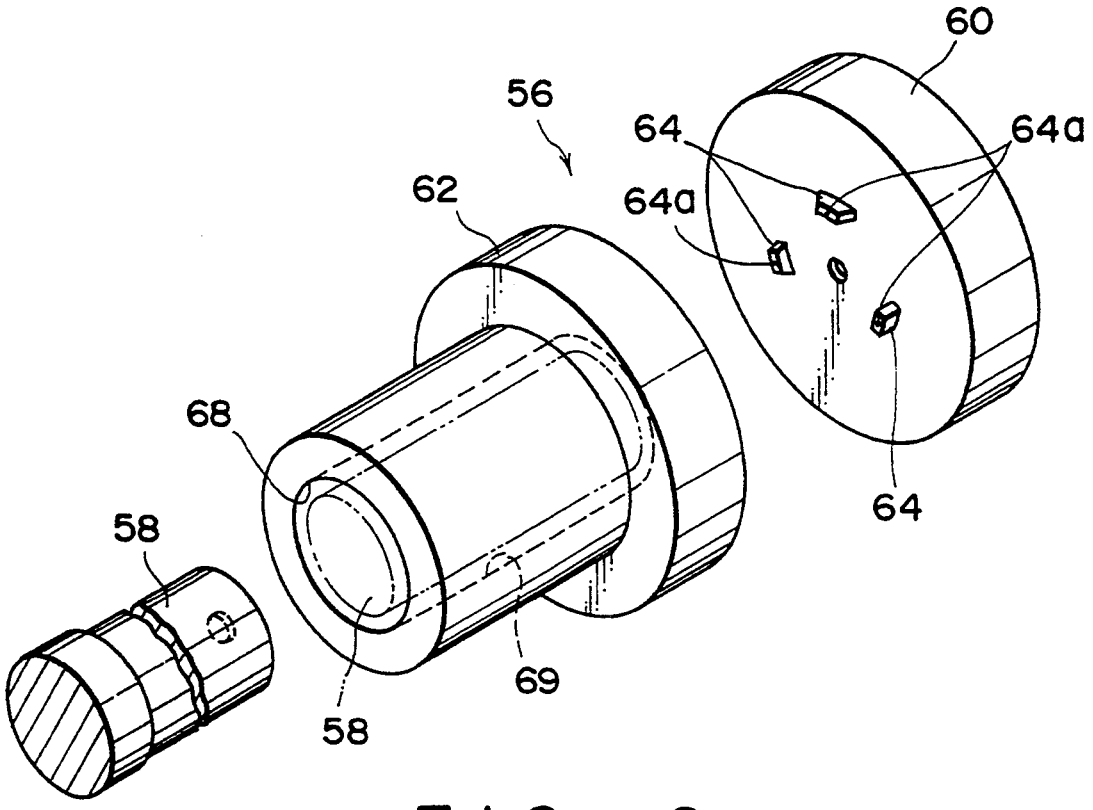

When a player purchases control of one of the prefecture/cities 36a or state/cities 36b, that player is provided with a card 44a or 44b (shown respectively in FIGS. 8A through 9B) identifying the prefecture/city or state/city controlled by the player. FIGS. 8A and 8B respectively disclose the front or face 46a of the card 44a, listing all of the various fiscal transactions which may occur in connection with that state/city (e.g., Arizona/Yuma), and the back 48a of the card 44a, further identifying the card and the loan amount which may be borrowed by a player holding that card. FIGS. 9A and 9B are similar, disclosing the front face 46b of a Japanese prefecture/city card 44b and the amounts for the various fiscal transactions involved with that prefecture/city, and the back 48b of the card 44b disclosing the loan amount.

In a similar manner, FIGS. 10A and 10B disclose a card 50 for a typical gasoline company of the present game, having a front face 50a identifying the company and providing relevant prices for related fiscal transactions, and an opposite rear face 50b identifying the company. FIGS. 11A and 11B disclose a card 52 having a front face 52a (FIG. 11B) with identification and financial information thereon and an opposite back face 52b (FIG. 11A) identifying the airport and card. While FIGS. 10A, 10B, 11A, and 11B disclose cards 50 and 52 relating respectively to companies and airports 40b and 38b of the U.S. side 10b of the board, it will be understood that similar cards (not shown, but discussed further below) are provided for the airports 38a and gasoline companies 40a of the Japanese side 10a of the board.

Figure 4:
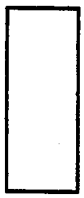
FIG. 4 is a view of a second type of tax token used in the present game, representing a maximum tax to be paid.
Figure 3:
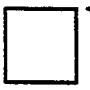
FIG. 3 is a view of a first type of tax token used in the present game, representing a standard or normal tax to be paid to the owner of the property by a player landing thereon.

When a player purchases control of one of the above prefecture/cities 34a or state/cities 34b, that player is considered to be "Mayor" of that position on the board. However, that player cannot collect fees ("taxes") from other players landing upon that position, until that player has become "Governor" of the state or prefecture by acquiring control of ALL of the cities of that state or prefecture. At that point, the "Governor" may "tax" other players who subsequently alight on those positions, according to the number of tax tokens 54/56 (FIGS. 3 and 4) purchased by the "Governor" for the city/state or city/prefecture and the "tax rate" provided on the card 44a or 44b corresponding to the city 34a or 34b. As an example, the "Arizona/Yuma" card 44a of FIG. 8A shows a fee or "State Tax Boost" of $50 for each tax token 54 purchased by the "Governor" of the state or prefecture, and the total fees for providing each city or all three cities with maximum tax tokens 56; tax tokens 54/56 must be divided as equitably as possible between all of the cities of a given state or prefecture. Again, a player must acquire ALL of the cities within a given state or prefecture before collecting fees from others.

The card face 46a of FIG. 8A describes the tax structure, i.e., a player landing on a controlled city having one tax token is subject to a tax payment or "State Tax #1" of $100. When a controlling player or "Governor" has acquired and placed additional tax tokens 54 thereon (by purchasing them from the bank at $50 each, in accordance with the "State Tax Boost" indicated), a player landing upon such a higher taxed property is subject to the state tax payments listed depending upon the number of tax tokens 54 on the position, up to a max state tax of $500 if a max tax token 56 has been placed upon that position.

Acquisition by a player of the airports 38a or 38b, and/or gasoline companies 40a or 40b, provides similar fiscal benefits to the controlling or owning player. FIG. 10B discloses the front face 50a of a gasoline company card 50, describing the fees due from a player landing upon that gasoline company position. In the case of the gasoline companies, the dice 26 are used as a chance means to determine the amount due to the owning player, depending also upon the number of gasoline companies owned by that player. In the case of a single gasoline company being owned by the controlling player, the dice are rolled and the player landing upon that gasoline company must pay ten times the amount shown on the dice in simulated U.S. currency. (Both U.S. and Japanese gasoline company fees are in U.S. currency, in order to simplify the exchange.) In the event that two gasoline companies on a single side 10a or 10b of the board are owned by the controlling player, then the subject player must pay twenty times the amount shown on the dice, in simulated U.S. currency. It will be noted that there are only two gasoline companies 40a on the Japanese side 10a of the board, and a corresponding two companies 40b on the U.S. side 10b of the board. However, the gasoline company cards have provision for up to four companies, in the event more are added to the board 10.

The airports 38a and 38b operate in a similar manner, except that no chance means is used to determine payment. In the case of the airports, "Air Fare" is charged to a player alighting on an airport position 38a or 38b by the owner thereof, depending upon the number of airports owned by the controlling player. The card 52 of FIG. 11B discloses the "fares" for a U.S. airport; the Japanese airport 38a fares in yen are 100 times the U.S. fares.

Tables listing the various prefecture/cities and state/cities, and the cards and values therefor, are provided below, in the order of travel about the board:

JAPANESE BOARD 10A

| PREFECTURE/ CITY | PRICE | TAX 1 | TAX 2 | TAX 3 | TAX 4 | MAX | LOAN |
|---|---|---|---|---|---|---|---|
| Miyazaki/ Nichinan | Y6000 | Y6000 | Y10000 | Y16000 | Y20000 | Y30000 | Y3000 |
| Miyazaki/ Miyakunojo | Y6000 | Y6000 | Y10000 | Y16000 | Y20000 | Y30000 | Y3000 |
| Miyazaki/ Miyazaki | Y6000 | Y6000 | Y10000 | Y20000 | Y30000 | Y40000 | Y3000 |
| Yamaguchi/ Ube | Y10000 | Y10000 | Y20000 | Y30000 | Y40000 | Y50000 | Y5000 |
| Yamaguchi/ Onada | Y10000 | Y10000 | Y20000 | Y30000 | Y40000 | Y50000 | Y5000 |
| Yamaguchi/ Yamaguchi | Y10000 | Y10000 | Y20000 | Y40000 | Y50000 | Y60000 | Y5000 |
| Nagasaki/ Amakusa | Y20000 | Y10000 | Y20000 | Y50000 | Y60000 | Y70000 | Y10000 |
| Nagasaki/ | Y20000 | Y10000 | Y20000 | Y50000 | Y60000 | Y70000 | Y10000 |

-continued

| | | | | | | | |
|---|---|---|---|---|---|---|---|
| Hondo | | | | | | | |
| Nagasaki/ Nagasaki | Y20000 | Y10000 | Y20000 | Y50000 | Y70000 | Y80000 | Y10000 |
| Kagushima/ Kaseda | Y20000 | Y10000 | Y30000 | Y60000 | Y70000 | Y90000 | Y10000 |
| Kagushima/ Kushikino | Y20000 | Y10000 | Y30000 | Y60000 | Y70000 | Y90000 | Y10000 |
| Kagushima/ Kagushima | Y20000 | Y10000 | Y30000 | Y60000 | Y80000 | Y100000 | Y10000 |
| Kyoto/ Magaoka | Y20000 | Y20000 | Y40000 | Y70000 | Y90000 | Y110000 | Y10000 |
| Kyoto/ Kameoka | Y20000 | Y20000 | Y40000 | Y70000 | Y90000 | Y110000 | Y10000 |
| Kyoto/ Kyoto | Y20000 | Y20000 | Y40000 | Y80000 | Y100000 | Y120000 | Y10000 |
| Hiroshima/ Iwakumi | Y20000 | Y20000 | Y50000 | Y90000 | Y110000 | Y130000 | Y10000 |
| Hiroshima/ Kure | Y20000 | Y20000 | Y50000 | Y90000 | Y110000 | Y130000 | Y10000 |
| Hiroshima/ Hiroshima | Y20000 | Y20000 | Y50000 | Y90000 | Y120000 | Y140000 | Y10000 |
| Niigata/ Sanjo | Y40000 | Y30000 | Y50000 | Y90000 | Y120000 | Y150000 | Y20000 |
| Niigata/ Niigsu | Y40000 | Y30000 | Y50000 | Y90000 | Y120000 | Y150000 | Y20000 |
| Niigata/ Niigata | Y40000 | Y30000 | Y50000 | Y90000 | Y120000 | Y150000 | Y20000 |
| Hokkaido/ Nayoro | Y40000 | Y30000 | Y50000 | Y100000 | Y130000 | Y160000 | Y20000 |
| Hokkaido/ Asahikawa | Y40000 | Y30000 | Y50000 | Y100000 | Y130000 | Y160000 | Y20000 |
| Hokkaido/ Koshiro | Y40000 | Y30000 | Y50000 | Y100000 | Y130000 | Y160000 | Y20000 |
| Osaka/ Amagasaki | Y40000 | Y40000 | Y60000 | Y110000 | Y140000 | Y170000 | Y20000 |
| Osaka/ Sakeri | Y40000 | Y40000 | Y60000 | Y110000 | Y140000 | Y170000 | Y20000 |
| Osaka/ Osaka | Y40000 | Y40000 | Y60000 | Y120000 | Y150000 | Y180000 | Y20000 |
| Tokyo/ Mitaka | Y40000 | Y40000 | Y70000 | Y120000 | Y160000 | Y190000 | Y20000 |
| Tokyo/ Kawasaki | Y40000 | Y40000 | Y70000 | Y120000 | Y160000 | Y190000 | Y20000 |
| Tokyo/ Tokyo | Y40000 | Y50000 | Y80000 | Y140000 | Y170000 | Y200000 | Y20000 |

U.S. BOARD 10A

| STATE/ CITY | PRICE | TAX 1 | TAX 2 | TAX 3 | TAX 4 | MAX | LOAN |
|---|---|---|---|---|---|---|---|
| Alaska/ Anchorage | $60 | $60 | $100 | $160 | $200 | $300 | $30 |
| Alaska/ Fairbanks | $60 | $60 | $100 | $160 | $200 | $300 | $30 |
| Alaska/ Juneau | $60 | $60 | $100 | $200 | $300 | $400 | $30 |
| Arizona/ Yuma | $100 | $100 | $200 | $300 | $400 | $500 | $50 |
| Arizona/ Tucson | $100 | $100 | $200 | $300 | $400 | $500 | $50 |
| Arizona/ Phoenix | $100 | $100 | $200 | $400 | $500 | $600 | $50 |
| Florida/ Miami | $200 | $100 | $200 | $500 | $600 | $700 | $100 |
| Florida/ Orlando | $200 | $100 | $200 | $500 | $600 | $700 | $100 |
| Florida/ Jacksonville | $200 | $100 | $200 | $500 | $700 | $800 | $100 |
| Hawaii/ Pearl City | $200 | $100 | $300 | $600 | $700 | $900 | $100 |
| Hawaii/ Hilo | $200 | $100 | $300 | $600 | $700 | $900 | $100 |
| Hawaii/ Honolulu | $200 | $100 | $300 | $600 | $800 | $1000 | $100 |
| Louisiana/ Shreveport | $200 | $200 | $400 | $700 | $900 | $1100 | $100 |
| Louisiana/ New Orleans | $200 | $200 | $400 | $700 | $900 | $1100 | $100 |
| Louisiana/ Baton Rouge | $200 | $200 | $400 | $800 | $1000 | $1200 | $100 |
| Alabama/ Huntsville | $200 | $200 | $500 | $900 | $1100 | $1300 | $100 |
| Alabama/ | $200 | $200 | $500 | $900 | $1100 | $1300 | $100 |

-continued

| | | | | | | | |
|---|---|---|---|---|---|---|---|
| Birmingham Alabama/ Montgomery | $200 | $200 | $500 | $900 | $1200 | $1400 | $100 |
| Missouri/ Kansas City | $400 | $300 | $500 | $900 | $1200 | $1500 | $200 |
| Missouri/ St. Louis | $400 | $300 | $500 | $900 | $1200 | $1500 | $200 |
| Missouri/ Jefferson City | $400 | $300 | $500 | $900 | $1200 | $1500 | $200 |
| Texas/ Houston | $400 | $300 | $500 | $1000 | $1300 | $1600 | $200 |
| Texas/ Dallas | $400 | $300 | $500 | $1000 | $1300 | $1600 | $200 |
| Texas/ Austin | $400 | $300 | $500 | $1000 | $1300 | $1600 | $200 |
| New York/ Manhattan | $400 | $400 | $600 | $1100 | $1400 | $1700 | $200 |
| New York/ New York City | $400 | $400 | $600 | $1100 | $1400 | $1700 | $200 |
| New York/ Albany | $400 | $400 | $600 | $1200 | $1500 | $1800 | $200 |
| California/ San Francisco | $400 | $400 | $700 | $1200 | $1600 | $1900 | $200 |
| California/ Los Angeles | $400 | $400 | $700 | $1200 | $1600 | $1900 | $200 |
| California/ Sacramento | $400 | $500 | $800 | $1400 | $1700 | $2000 | $200 |

In addition to the above prefect/cities and state/cities, there are other positions representing airports (38*a* and 38*b*) and gasoline companies (40*a* and 40*b*). Each of the boards 10*a* and 10b includes five airports and two gasoline companies; more or fewer such positions 38*a*, 38*b*, 40*a*, and/or 40*b* may be included in the present game as desired. The fiscal transactions relating to the airports 38*a* and 38*b* and gasoline companies 40*a* and 40*b* have been described above. The fee for each of the above positions is $200 (for those positions 38*b* and 40*b* on the U.S. board 10*b*) or the equivalent Y20,000 (for those positions 38*a* and 40*a* on the Japanese board 10*a*). Loan value for each is one half the purchase fee.

As play progresses about either board 10*a* or 10*b*, additional playing positions other than those described above will be encountered. Assuming play commences from the Japan border position 22*a*, a player will encounter an "Economy" space or position 58*a* two positions following the border position 22*a*. Two such economy positions 58*a* are located along the opposite first and third sides 14*a* and 18*a* of the playing path 12*a* of the Japanese board 10*a*, with a corresponding two economy positions 58*b* on the U.S. board 10*b*; more or fewer may be used as desired.

Figure 7A:
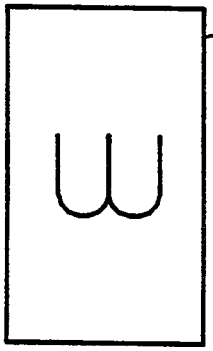
FIG. 7A is a view of the back of an "Economy" card used in the present game.
Figure 7B:
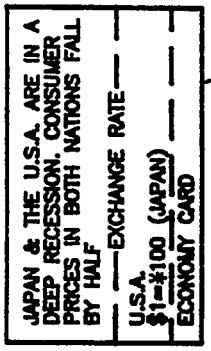
FIG. 7B is a view of the front or face of a typical "Economy" card, showing one of the instructions provided on such cards.

When a player lands on such an economy position 58*a* (or 58*b*, depending upon the board 10*a* or 10*b*), an economy card must be drawn from the economy card space 60 of the U.S. board 10*b* and the instructions followed. FIGS. 7A and 7B respectively disclose the back 62*a* and front or face 62*b* of a typical economy card 62. Economy cards 62 affect the prices around the board and the differential exchange rates between currencies, as well as other factors. A plurality of economy cards 62 is shuffled and placed face down on the economy card space 60 at the beginning of the game.

A listing of the economy cards used in the present game is shown below:

"GOOD TIMES" CARDS

Good times enable the Japanese (or U.S.) Government to award you Y100,000 (or $1,000) for governing your cities well. You are also awarded any city and gasoline company you wish in Japan (or U.S.) which is available.

"FUEL TAX" CARDS

Japan (or the U.S.) imposes a high fuel tax. Air fares and gasoline prices double in Japan (or the U.S.) Any "Star Card" drawn in Japan (or the U.S.) pays twice the listed value.

"DEPRESSION" CARDS Japan (or the U.S.) is in a depression. Consumer prices in Japan (or the U.S.) drop by one half. The yen (or dollar) doubles in value. Exchange rate is Y100=$2 (or $1=Y200).

"INTERNATIONAL RECESSION" CARDS

Both Japan and the U.S. are experiencing recessions. Consumer prices in both nations decrease by one half. The exchange rate is $1=Y100.

"INFLATION" CARDS

Japan (or the U.S.) experiences high inflation. Consumer prices in Japan (or the U.S.) double. The yen (or dollar) loses half its value. The exchange rate is Y200=$1 (or $2=Y100).

"INTERNATIONAL INFLATION" CARDS

Inflation hits both Japan and the U.S. Consumer prices in both nations double. The exchange rate is $1=Y100.

"HIGH INTEREST" CARDS

The Japanese (or U.S.) Government forces interest rates up to prevent an inflationary boom which is attractive to currency investors; the yen (or dollar) doubles in value. Japanese (or U.S.) consumer prices remain the same. Exchange rate is $1=Y100.

"RECESSION" CARDS

Japan (or the U.S.) is in a recession. The Japanese (or U.S.) Government forces interest rates down to stimulate the economy, which action is unattractive to currency investors. The yen (or dollar) loses one half its value. Exchange rate is Y200=$1 (or $2=Y100).

Preferably, four of the "good times" economy cards are provided, which cards are exercised by the individual player drawing such a card as soon as the card is drawn. A "good times" economy card is returned to the bottom of the deck as soon as it is drawn and exercised. The remaining cards effect the economy of the game for all players, at least over half of the game board. Preferably, one of each of the remaining cards is provided for U.S. economic conditions, and one of each for Japanese economic conditions; more or fewer of any or all of the above cards may be provided as desired. These remaining cards, effecting relative exchange rates between the yen and dollar used in the play of the present game, are turned face up on the top of the economy card deck in order to remind all players of the current exchange rates and/or economic conditions effected by the card. When any player lands upon another economy card position 58*a* or 58*b* and draws another card effecting the game economy and/or exchange rate, any face up economy card previously at the top of the deck is turned face down and returned to the bottom of the deck.

Figure 6A:
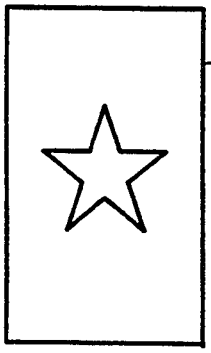
FIG. 6A is a view of the back of a "Star" card used in the present game.
Figure 6B:
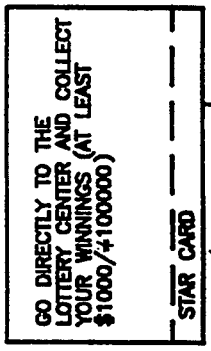
FIG. 6B is a view of the front or face of a typical "Star" card, showing one of the instructions provided on such cards.

As a player continues clockwise around the game board 10*a* from the Japan border position 22*a*, he/she will encounter a "Star" position 64*a* (or its equivalent 64*b* on the U.S. half of the board 10*b*, assuming play on that portion of the board). When a player lands on such a star position 64*a* (or 64*b*, depending upon the board 10*a* or 10*b*), a star card must be drawn from the star card space 66 of the Japanese board 10*a* and the instructions followed. FIGS. 6A and 6B respectively disclose the back 68*a* and front or face 68*b* of a typical star card 68. Star cards 68 might be considered "wild cards," in that they provide an unforeseen benefit (or penalty) for a player drawing such a card 68. A plurality of star cards 68 is shuffled and placed face down on the star card space 66 at the beginning of the game. A listing of the star cards 68 used in the present game is shown below:

"REWARD" CARDS

Collect $300 (or Y30,000) for city services well done.

"PENALTY" CARDS

Pay a penalty of ten percent of your cash, or $200 (or Y20,000).

"SWEEPSTAKES" CARDS

Roll the dice and win 100 times the number rolled,

"PUSH YOUR LUCK" CARDS

Roll the dice—total from one to six=lose $600 (Y60,000). Total of seven=no win or loss, Total of eight to twelve=win $600 (Y60,000).

"TRAVEL" CARDS (1) Go to the nearest airport and pay double the normal air fare.

(2) Go to the nearest gasoline company and pay $20 (Y2,000) times the roll of the dice.

(3) If in the U.S.A., go directly to Miami, Fla. (or other U.S. cities/states may be named on other cards).

(4) If in Japan, go directly to Amakusa Islands, Nagasaki (or other Japanese cities/prefectures may be named on other cards).

"BORDER" CARDS

Advance to the borderline and collect your $200 (or Y20,000) salary.

"ECONOMY POSITION" CARDS

Move directly to the nearest Economy Card position and draw a card.

"MAYOR" CARDS

Advance to the nearest city without a mayor, and become mayor of that city at no cost to you. Alternatively, collect your normal salary.

"DETENTION" CARDS

You have been arrested—go directly to the nearest detention center. Roll seven or eleven with the dice within three turns (maximum three attempts at each turn), or pay $100 (Y10,000) fine for release.

"LOTTERY" CARDS

Go directly to the nearest Lottery position, and collect your winnings of $1,000 or Y100,000.

Preferably, a total of forty of the star cards 68 are provided, which cards are exercised by the individual player drawing such a card as soon as the card is drawn and returned to the bottom of the deck as soon as it is drawn and exercised, in the manner of the "good times" economy cards 62 discussed above. The star cards 68 may be divided into groups of seventeen "Reward" and "Penalty" cards, eleven "Travel" cards, two each of the "Sweepstakes," "Border," "Economy Position," "Detention," and "Lottery" cards, and one each of the "Push Your Luck" and "Mayor" cards. More or fewer of any of the above cards, or others, may be provided as desired.

Continuation of travel along the peripheral playing path 12*a* of the board 10*a* (or its counterpart path 12*b* of board 10*b*) will eventually lead a player to one of the "Detention Center" positions 70*a* (or 70*b*). A player alighting upon such a detention center position 70*a*/70*b* incurs no penalty if such move is made in the normal course of advancement of that player's marker 24 along the playing path 12*a*/12*b*; the player may accordingly position his/her marker 24 in the "visiting" area of the detention position 70*a*/70*b* and continue to play and advance in turn according to the normal rules of play. However, penalties are incurred for a player who is required to remain in the detention area, as will be described further below.

Continuing the advance along the peripheral playing path 12*a*/12*b*, a player will reach a "Lottery" position 72*a*/72*b*. A player landing upon one of the lottery positions 72*a*/72*b*, receives a minimum of $1,000 (for the lottery position 72*b* on the U.S. board 10*b*) or Y100,000 (for the corresponding position 72*a* on the Japanese board 10*a*) for "winning the lottery."

Further advance along the peripheral playing paths 12*a*/12*b* brings a player to the "Deported" position 74*a*/74*b*, respectively. When a player lands on one of the "deported" positions 74*a*/74*b*, that player is immediately required to remove his/her marker 24 to the appropriate border crossing position 22*a*/22*b*, and collect the appropriate salary. As an example, a player alighting on the "deported" position 74*a* on the Japanese side 10*a* of the board, would be required to move his/her marker 24 directly to the U.S. side borderline position 22*b*, collect $200, and continue play along the U.S. peripheral playing path 12*b*. A player being deported from the U.S. to the Japanese side would collect his/her salary in yen, at Y20,000.

Finally, as a player passes the three quarter distance point on his/her lap around either of the boards 10*a* or 10*b*, he/she will encounter a "Go To Detention Center" position 76*a* or 76*b*. A player landing upon that position 76*a* or 76*b*, must remove his/her marker 12 and place it within the appropriate detention center position 70*a* or 70*b*, depending upon the board 10*a* or 10*b* the player is using at the time. (Transfer of a player's marker directly to the appropriate detention center position 70*a* or 70*b* is also required when a player draws a Star Card 66 instructing him/her to do so, as described above, or when a player rolls three consecutive doubles with the dice 26.) A player may be released from the detention center position 70*a*/70*b* in one of two ways: (1) by tossing doubles with the dice 26 (a player is given three chances per turn for three turns); (2) if unable to toss doubles in the nine chances provided, then the player must pay a fine of $100 (or Y10,000, as appropriate) to the lottery center, which fee is added to any lottery winnings for the next player to win the lottery.

Play continues in the above manner, with the players continuing to travel clockwise about the two peripheral playing paths 12*a* and 12*b* respectively of the boards 10*a* and 10*b*, and crossing from one board to the other at the respective border crossing positions 22*a*/22*b*, whereupon each player doing so is paid a "salary" of $200/Y20,000, as appropriate. Players will continue to accrue (or lose) wealth in the form of both U.S. dollars and Japanese yen, cities, and tax tokens during the course of play, with at least some of the players eventually losing all of their wealth and becoming "bankrupt." Those bankrupt players are no longer allowed to play, and are out of the game. The game may be played until only one player remains, or alternatively may be played to a time limit, as the relatively complex rules and changing exchange rates will be seen to provide a game which may be of quite lengthy duration. In some cases, the "bank" may become insolvent, whereupon those players remaining in the game audit their wealth, with the "richest" player being the winner.

Particularly in the case of several players playing the present game, it will be seen that, after players have purchased control of most or all of the cities, relatively few of the cities of a given state or prefecture will be controlled by a single player. With no single player controlling all of the cities of a given state or prefecture, no player may purchase tax tokens for placement on those cities in order to increase the taxes due to the controlling player from other players alighting upon that city. Accordingly, the rules of the present game provide for different levels of trading of city control among the players, in order to allow the trading players to gain control of all of the cities within a given state or prefecture.

The combined boards 10*a* and 10*b* will be seen to have a total of twenty different states or prefectures, each including a group of three different cities and distinguished by color bands 36*a*/36*b*. In order for players to acquire control of all of the cities of a given group (state or prefecture), three different types of trades may be made, described as follows:

1. Perfect Trade: In this situation, a first player has control of two of the cities marked by a given color band in a first nation, and a second player has control of two of the cities marked by the same color (and thus having the same values and tax rates) in the second nation. The first player also has control of the third city of the second nation which could complete the second player's group, and the second player has control of the third city of the first nation which could complete the first player's group. In such a situation, the two players may exchange the single cities each holds, thus enabling both players to have control over all three of the cities of a given color (state or prefecture), and thereby allowing both players purchase and install tax tokens on those cities.
2. Fair Trade: This situation differs from the above "perfect trade" scenario, in that each player holds cities of two different states/prefectures (colors) having slightly different values and tax rates. If the trade is mutually acceptable to both players, they may exchange the single cities in order to allow both players to gain control over an entire group, even though one group may have a slightly higher tax rate than the other group. This nevertheless may be the only way in which the players may gain any control over a single group of cities, and thus accelerate the progress of the game.

In some cases, a third and fourth player may have a potential trade similar to the above "fair trade," but with the respective city values and tax rates being significantly different. Nevertheless, the players may make a trade if they wish; this may be the only means of the third or fourth player acquiring sufficient strength to have any chance of winning against the first two players.

3. Unfair Trade: In this scenario, the first player controls two cities having a significantly greater value and tax rate than the two cities controlled by the second player. As in the "perfect trade" and "fair trade" described above, each player controls the single city the other needs to gain control over the entire group. The two players may trade their single cities to one another, but it will be seen that the first player will achieve a significant advantage over the second player due to the first player's significantly more valuable cities and their correspondingly higher tax rates. Accordingly, the first player must surrender all of the gasoline companies and airports he/she holds to the second player, as compensation for the otherwise advantageous trade to the first player.

The above described game may be simplified significantly by using only a single board 10*a* or 10*b*, and accordingly eliminating one currency and the variable exchange rates, as well as all cities, gasoline companies, and airports from the unused board. Economy cards controlling exchange rates are disregarded; other economy cards are used to vary consumer prices according to the cards. Cities may be traded, but it will be seen that "perfect trades" will not be possible, due to the lack of exactly corresponding cities from the second board.

As can be imagined, the above simplification also leads to a game of shorter duration. However, in many cases the players may not wish to limit the complexity of the game, with its variable currency exchange rates, and will therefore wish to use both portions of the board 10*a* and 10*b*. Nevertheless, some shortening of the duration of the game may be desirable if the time available to one or more of the players is limited. Accordingly, much of the time involved in the initial part of the game may be reduced by removing the gasoline company and airport cards 50 and 52 from the game, and retaining only the city/prefecture and city/state cards 44*a* and 44*b*. The initial issue of the city cards 44a/44b is accomplished by shuffling them and dealing three each randomly to the players of the game. The players must then pay the bank for control of the cities, in accordance with standard rules. The game and play thereof may then commence according to the standard rules of play, described further above. As can be seen, the elimination of the gasoline and airport properties, along with the initial dealing of three city cards to each of the players, streamlines the game considerably without reducing the complexity and interest. A time limit may be set for the end of the game, with the player acquiring the greatest wealth being the winner.

Initially, the fluctuating exchange rates may be confusing to the novice player. If so, then the economy cards 62, or at least those controlling the exchange rates, may be eliminated from the game. If none of the economy cards 62 are used, then the economy positions 58a/58b may be disregarded during play, and treated as "free positions" where no financial transactions or other actions are required of a player alighting thereon. Other rules as described above may be used as appropriate.

Figure 13A:
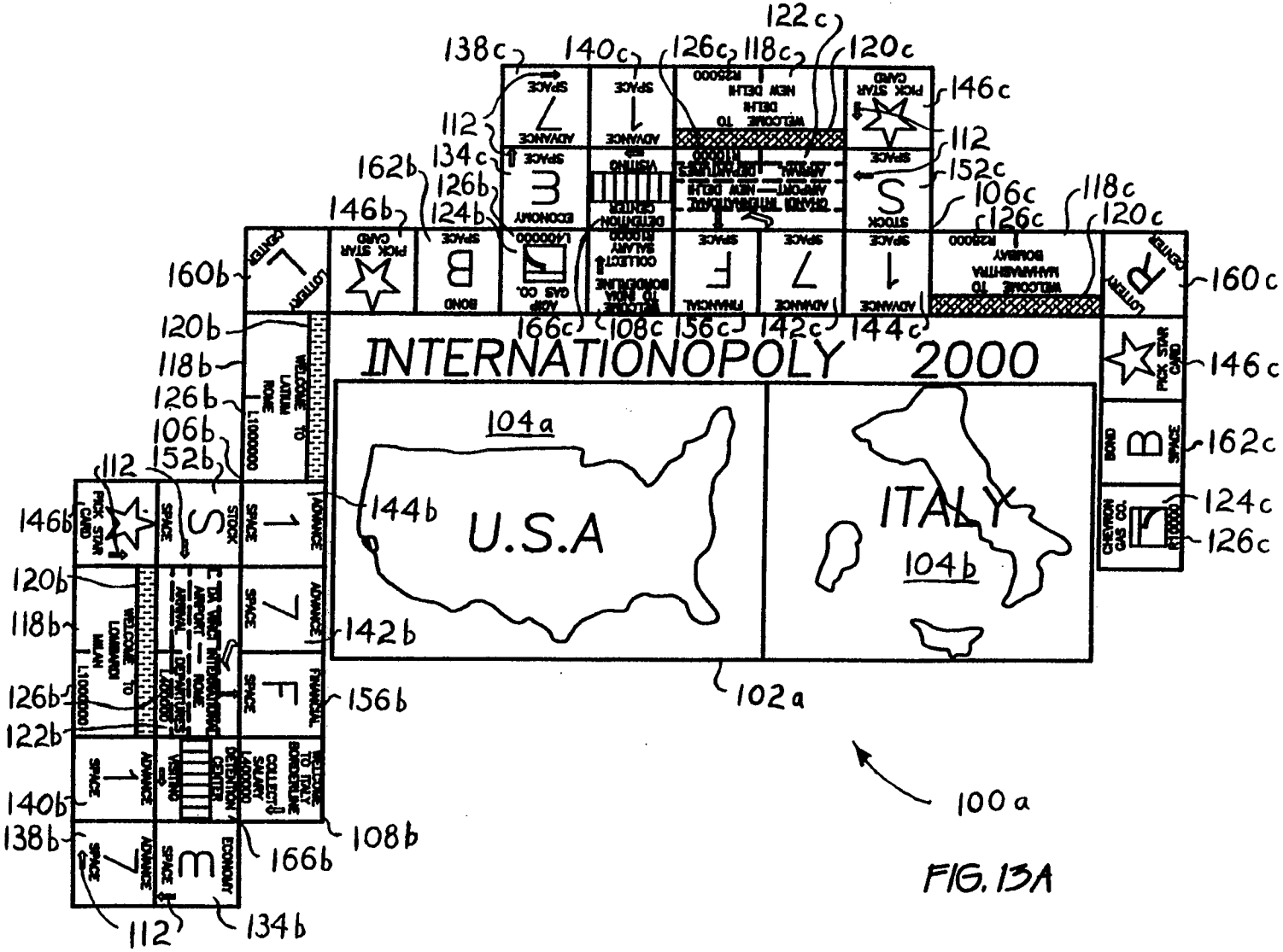
FIG. 13A is a plan view of one half of the game board of the present game apparatus for a second embodiment of the present game, showing the various features thereof.
Figure 13B:
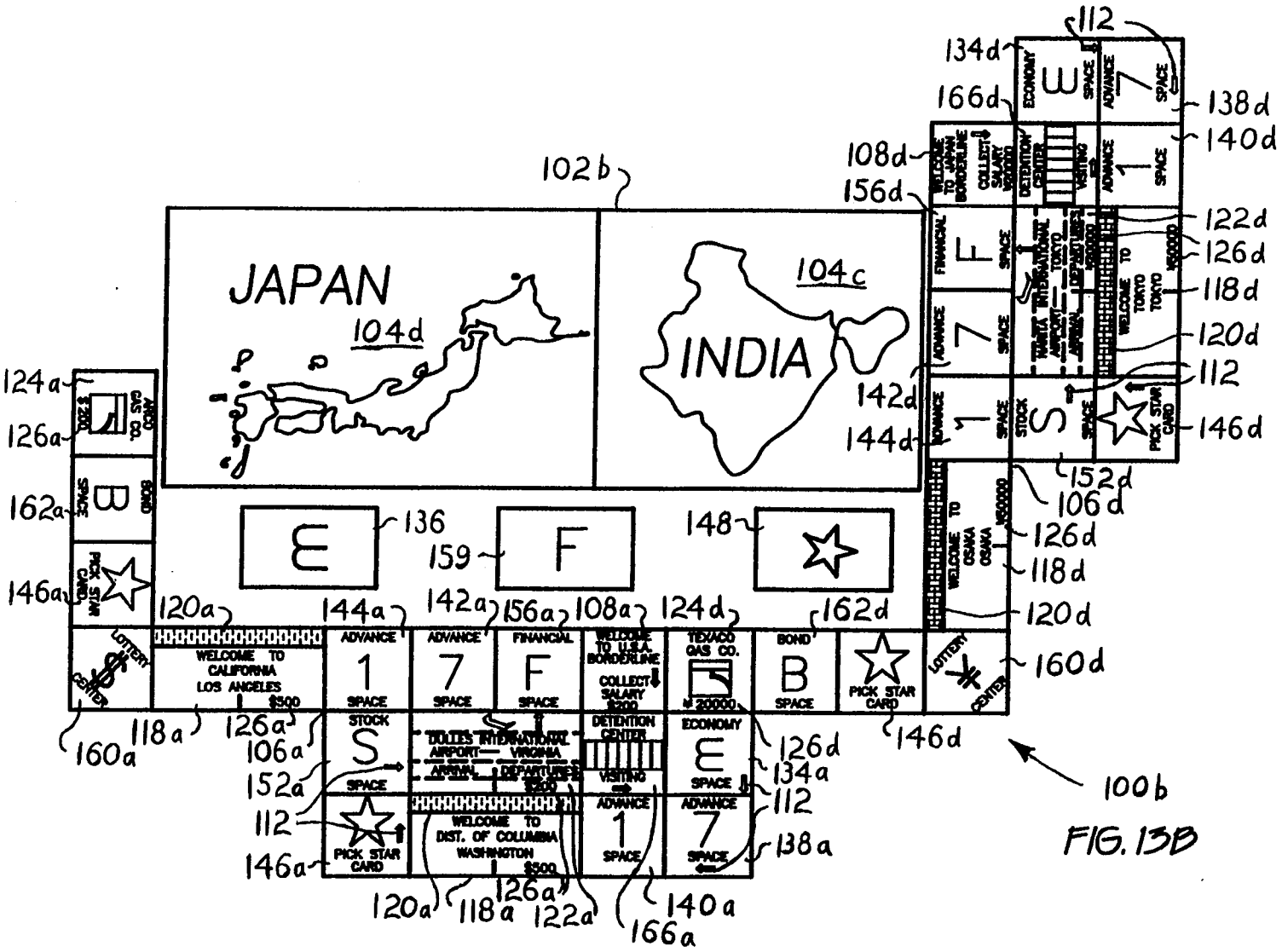
FIG. 13B is a plan view of the second half of the above game board.

A variation on the above game apparatus is disclosed in FIGS. 13A and 13B, where a board or boards 100a and 100b is disclosed. Boards 100a and 100b are joined along a common edge 102a and 102b to form a complete game board for a second embodiment of the present game, comprising simulated financial transactions and currency exchanges among four different nations and currencies. (It will be understood that the common "break line" 102a/102b shown in FIGS. 13A and 13B need not represent an actual fold line or separation line between the two board portions 100a/100b. The break or fold, if any, may be provided at any line(s) across the board portions 100a/100b. The division of the board portions 100a/100b shown in FIGS. 13A and 13B is provided for continuity of the playing positions and respective nations represented, with two complete nations represented in each of the drawing FIGS. 13A and 13B.)

The board 100a/100b comprises four quadrants 104a, 104b, 104c, and 104d, designating four different nations (respectively the U.S.A., Italy, India, and Japan; other nations may be used as desired). A generally peripheral playing path 106, having segments 106a through 106d, is disposed about the four quadrants, with each of the playing path segments 106a through 106d corresponding to one of the nations of the quadrants 104a through 104d. (It will be noted that the segments 106a through 106d are not necessarily immediately adjacent to the corresponding quadrants 104a through 104d.) Each playing path segment 106a through 106d begins with a "borderline" playing position, respectively 108a through 108d, similar to the borderline positions 22a and 22b of the game board 10a/10b. Each segment 106a through 106d also includes a folded extension therealong, to provide additional playing positions.

Figure 14:
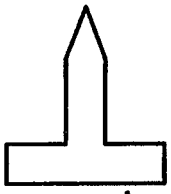
FIG. 14 is a view of a player position marker used in the second embodiment of the present game.

FIG. 14 discloses the configuration of a player position marker 110 used in the play of the game of the second embodiment. One marker 110 is provided for each player of the game, with each player's marker being of a different color. Alternatively, markers having a different configuration(s) may be used, if desired. Markers 110 are used to designate the position of each player of the game along the playing path segments 106a through 106d of the board(s) 100a and 100b. The rules of the game of the second embodiment provide for movement of the player position markers 110 from one board portion to another, sequentially along the generally peripheral playing path segments 106a through 106d and their respective extensions in accordance with the directional arrows 112 located at points where the direction of travel changes along the playing path 106.

The object of the game of the second embodiment is the same as that of the first embodiment, i.e., to acquire the greatest amount of simulated wealth during the course of the game. The game is preferably played to a time limit, with the player accruing the greatest simulated wealth being the winner. Alternative end game limits may be used if desired, e.g., playing until no more simulated currency is held by the "bank" and all such currency is in the hands of the players; playing until all possible purchases on the board have been made by the players; etc. Accordingly, as in the game of the first embodiment, each player is issued equal amounts of simulated currency for the nations represented on the board (e.g., U.S. dollars, Italian lire, Indian rupees, and Japanese yen) before beginning play. Each player starting the game is provided with simulated currency in the amount of US$500, L1,000,000, R25,000, and Y50,000, appropriately divided.

Up to eight players may play the game of the second embodiment, thus requiring a total of $4,000, L8,000,000, R200,000, and Y400,000 in simulated currency. In addition, an equal "bank" or reserve for periodic payouts to players as they complete a cycle around the playing path of each board portion 100a and 100b, is preferably provided; the precise amount of simulated currency provided may be adjusted according to the values selected for the simulated fiscal transactions, the currencies simulated for each nation, and/or the number of players.

FIGS. 12A through 12D disclose views respectively of a U.S. currency note 28, a Japanese yen note 30, an Italian lira note 114, and an indian rupee note 116. In order to add greater interest to the game of the second embodiment, the respective absolute values of the four simulated currencies 28, 30, 114, and 116 are different, with the U.S. currency 28 having a value of 100 times that of the Japanese currency 30, 2,000 times that of the Italian currency 114, and 50 times that of the Indian currency 116. In other words, one U.S. dollar is equal to 100 Japanese yen, 2,000 Italian lire, or 50 Indian rupees. This is a reasonable approximation of the present actual exchange rate between the four currencies, and is selected in order to provide for ease of translation between the four currencies 28, 30, 114, and 116. The basic dollar/yen exchange ratio for the present game may be determined by shifting the decimal point to the left or right two positions, as appropriate. For dollar/lire or lire/dollar conversions, the decimal point is respectively shifted right or left three places and the sum doubled or halved. Finally, for dollar/rupee or rupee/-dollar transactions, the decimal point is shifted right or left two places and the sum halved or doubled.

The order of play is determined in the same manner as described for the game of the first embodiment discussed further above. All players then place their position markers 110 on the U.S. point of entry position 108a, from which the play of the game is started. The first player tosses the dice 26 again, and moves his/her position marker along the U.S. portion 106a of the peripheral playing path, in the direction indicated by the arrows 112 located in the border crossing positions 106a through 106d and other locations about the playing path, proceeding generally clockwise about the board 100a/100b.

Each quadrant 104*a* through 104*d* and associated playing path segment 106*a* through 106*d* is essentially equivalent to each of its counterparts and contains two U.S. "State/City" positions 118*a*, two equivalent Italian "State/City" positions 118*b*, two equivalent Indian "State/City" positions 118*c*, and two "Prefecture/City" positions 118*d*, respectively located on the U.S., Italian, Indian, and Japanese playing path segments 106*a* through 106*d*. Each group of two state/city or prefecture/city positions 118*a* through 118*d* foe each nation is distinguished by color (as in the colored areas 120*a* through 120*d* respectively of the state/city and prefecture/city positions 118*a* through 118*d*) from other city/states or prefecture/states of other nations, in order for players to determine cities of like nations more readily. Other positions represent international airports 122*a* through 122*d* and gasoline companies 124*a* through 124*d*, respectively of playing path segments 106*a* through 106*d*. Each of the above positions 118*a* through 118*d* and 122*a* through 124*d* includes a respective price 126*a* through 126*d* the appropriate currency 28, 30, 114, or 116, which must be paid to the bank for a player to gain control of that position.

Figure 15B:
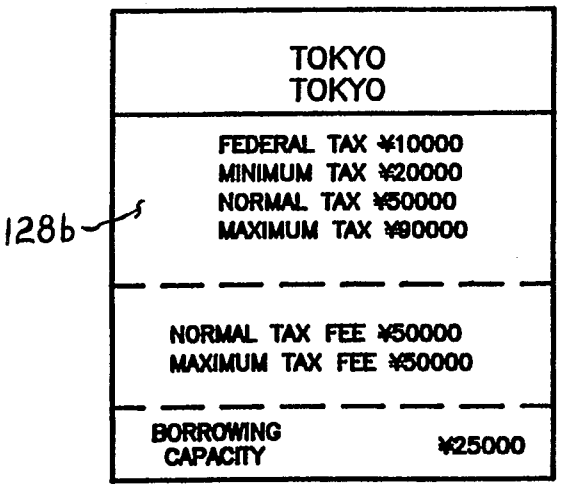
FIG. 15B is a view of the front or face of the State/-City or Prefecture/City card of FIG. 15A, showing the "tax rates" for a player landing on that playing space according to the tax tokens purchased by the player-owner, and the cost of acquiring tax tokens for that state/city or prefecture/city.
Figure 15A:
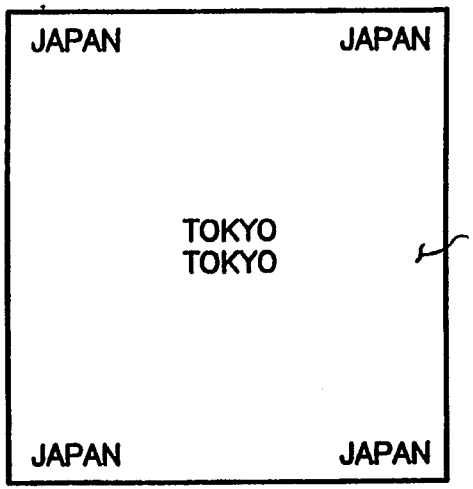
FIG. 15A is a view of the back of a typical State/City or Prefecture/City card used in the second embodiment of the present game, identifying the state/city or prefecture/city.

When a player purchases control of one of the state/-cities or prefecture/cities 118*a* through 118*d*, that player is provided with a card, exemplified by the card 128 shown in FIGS. 15A and 15B, identifying the prefecture/city or state/city controlled by the player. FIGS. 15A and 15B respectively disclose the back 128*a* of the card 128, identifying the card, and the front or face 128*b* of the card 128, listing all of the various fiscal transactions which may occur in connection with that prefecture/city (e.g., Tokyo/Tokyo), and the loan amount which may be borrowed by a player holding that card. Other cards, with the transaction fees listed in the appropriate currency, are provided for the other state/cities or prefecture/cities.

Figure 16A:
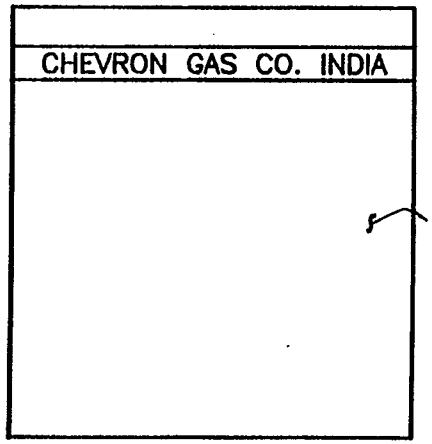
FIG. 16A is a view of the back of a typical "Gas Company" card used in the second embodiment of the present game, identifying the gas company.
Figure 17A:
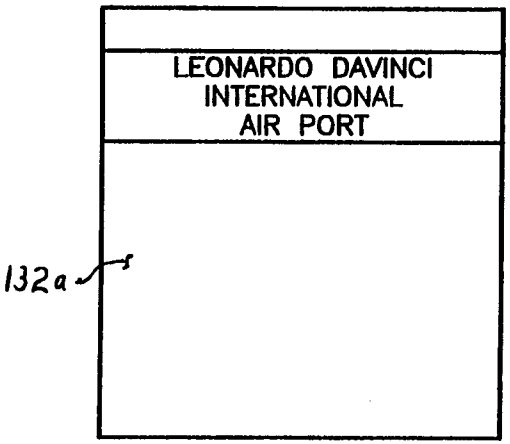
FIG. 17A is a view of the back of a typical "International Airport" card used in the second embodiment of the present game, identifying the airport.
Figure 16B:
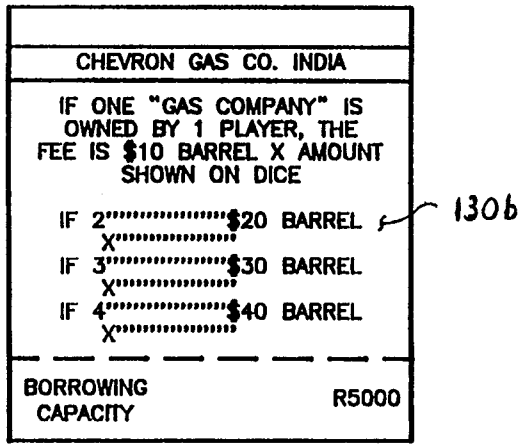
FIG. 16B is a view of the front or face of the "Gas Company" card of FIG. 16A, showing the rates to be paid by a player landing upon that playing space to the player-owner thereof and the borrowing capacity for the player-owner.
Figure 17B:
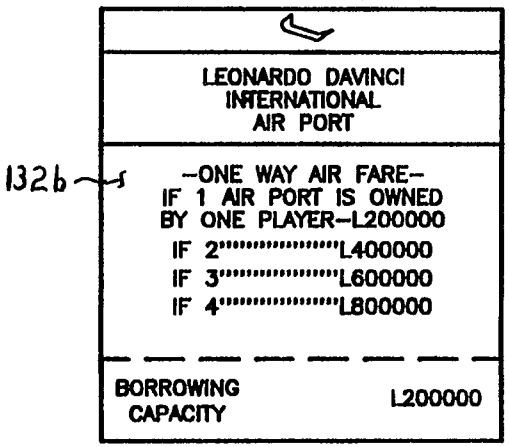
FIG. 17B is a view of the front or face of the "International Airport" card of FIG. 17A, showing the fees to be paid by a player landing upon that playing space to the player-owner thereof and the borrowing capacity for the player-owner.

In a similar manner, FIGS. 16A and 16B disclose a card 130 for a typical gasoline company of the game of the second embodiment, having a rear face 130*a* identifying the company and nation (e.g., Chevron, India) and an opposite front face 130*b* identifying the company and nation and providing relevant prices for related fiscal transactions. Again, additional cards for the gasoline companies of the other nations are also provided. FIGS. 17A and 17B disclose a card 132 having a front face 132*b* (FIG. 17B) with identification and financial information thereon and an opposite back face 132*a* (FIG. 17A) identifying the airport and card. While FIGS. 16A, 16B, 17A, and 17B disclose cards 130 and 432 relating respectively to a specific gasoline company and international airport 124*c* and 122*b* of the portion 100*a* of the board shown in FIG. 13A, it will be understood that similar cards (not shown, but discussed further below) are provided for the airports 124*a*, 124*b*, and 124*d* and gasoline companies 122*a*, 122*c*, and 122*d* of the remainder of the board.

When a player purchases control of a state/city 118*a* through 118*c* or prefecture/city 118*d*, that player is considered to be "Mayor" of that position on the board and may "tax" other players who subsequently alight on that position, according to the "tax rate" on the card 128 corresponding to the city 118*a* through 118*d*. As an example, the front face 128*b* of the "Tokyo/Tokyo" card 128 of FIG. 15*b* shows a "Minimum Tax" of Y20,000 which is applicable to a player landing upon that playing position and payable to the controlling player or "Mayor," if the controlling player does not control all other cities of that nation (indicated by like colors and identical national names). A player having control of a single city may purchase a single tax token 54 (FIG. 3) from the bank for the "Normal Tax Fee" of Y50,000 listed on the bottom of the front of the card 128*b*, and may then charge other players landing upon that city the "Normal Tax" of Y50,000 listed on the front of the card 128*b*. (If a player lands upon a city not yet controlled by another player, and does not wish to purchase control, then the minimum "Federal Tax" of Y10,000 must be paid to the bank.)

However, if the controlling player has acquired control of both of the cities in a given nation (e.g., Tokyo and Osaka, Japan), then that player may increase the taxes collectable by exchanging tax tokens 54 (if any) for max tax tokens 56 (FIG. 4) from the bank, and payment of the "Maximum Tax Fee" of Y50,000 listed on the card 128*b*. A player landing upon such a higher taxed property is taxed at the "Maximum Tax" of Y90,000 if a max tax token 56 has been placed upon that position. All cities of the game of the second embodiment have identical tax values, differing only according to the exchange rate.

Acquisition by a player of one or more of the airports 122*a* through 122*d*, and/or gasoline companies 124*a* through 124*b*, provides similar fiscal benefits to the controlling or owning player. FIG. 16B discloses the front face 130*b* of a gasoline company card 130, describing the fees due from a player landing upon that gasoline company position. The fees are determined using the dice 26 just as in the game of the first embodiment discussed above, depending upon the number of gasoline companies owned by a player. The exemplary card 130 of FIGS. 16A and 16B is for the gasoline company 124*c* of the India playing path segment 106*c*, and accordingly the rates are provided in rupees. However, the values of each of the equivalent payments required (depending upon the number of gasoline companies owned by a player) are equal, and vary only according to the exchange rates between the four different currencies of the second embodiment game.

The airports 122*a* through 122*d* will be seen to cover the equivalent of two playing positions each, having an arrival side and a departure side. A player alighting upon the arrival side of any of the airports 122*a* through 122*d* need take no further action, as no fiscal or other transaction is due. However, a player landing upon the departure side of any of the airports 122*a* through 122*d* must pay "air fare" to the owner of the airport according to the number of airports owned, as in the first embodiment discussed above. In return, the player paying the air fare may transfer his/her marker 110 to any one of the other three airports on the board 10*a*/100*b*, as desired. As this transfer is direct and does not follow the playing path 106 through any of the borderline positions 108, no "salary" is paid to the "traveling" player. All departure fees are equal in value, varying only due to exchange rates.

Tables listing the various state/cities and prefecture/-cities, and the cards and values therefor, are provided below, in the order of travel about the board:

U.S. PLAYING PATH SEGMENT 106a

-continued

| STATE/ CITY | PRICE | FEDERAL TAX | MINIMUM TAX | NORMAL TAX | MAXIMUM TAX | LOAN |
|---|---|---|---|---|---|---|
| District of Columbia/ Washington | $500 | $100 | $200 | $500 | $900 | $250 |
| California/ Los Angeles | $500 | $100 | $200 | $500 | $900 | $250 |
| ITALIAN PLAYING PATH SEGMENT 106B | | | | | | |
| STATE/ CITY | PRICE | FEDERAL TAX | MINIMUM TAX | NORMAL TAX | MAXIMUM TAX | LOAN |
| Lombardi/ Milan | L1000000 | L200000 | L400000 | L1000000 | L1800000 | L500000 |
| Latium/ Rome | L1000000 | L200000 | L400000 | L1000000 | L1800000 | L500000 |
| INDIAN PLAYING PATH SEGMENT 106C | | | | | | |
| STATE/ CITY | PRICE | FEDERAL TAX | MINIMUM TAX | NORMAL TAX | MAXIMUM TAX | LOAN |
| Delhi/ New Delhi | R25000 | R5000 | R10000 | R25000 | R45000 | R12500 |
| Maharashtra/ Bombay | R25000 | R5000 | R10000 | R25000 | R45000 | R12500 |
| JAPANESE PLAYING PATH SEGMENT 106D | | | | | | |
| PREFECTURE/ CITY | PRICE | FEDERAL TAX | MINIMUM TAX | NORMAL TAX | MAXIMUM TAX | LOAN |
| Tokyo/ Tokyo | Y50000 | Y10000 | Y20000 | Y50000 | Y90000 | Y25000 |
| Osaka/ Osaka | Y50000 | Y10000 | Y20000 | Y50000 | Y90000 | Y25000 |

Again, the relative values of each of the above fees is the same; the exchange rate differs to produce the above numbers.

As play progresses about the board **100*a*/100*b* and along the playing path 106, additional playing positions other than those described above will be encountered. Assuming play commences from the U.S. border position 108*a*, a player will first encounter an "Economy" space or position 134*a* two positions following the border position 108*a*. (Player position marker movement must follow the arrows downward, through the "Detention Center" position, and then to the right to the Economy position 134*a*. It is not possible to end the first move on the Detention Center position, due to the minimum move of two positions provided by the minimum number available on the two dice 26 used as the chance means for the present game.) Four such economy positions 134*a* through 134*d* are located respectively along the playing path segments 106*a* through 106*d* of the board 100*a*/100*b***; more or fewer may be used as desired.

Figure 18:
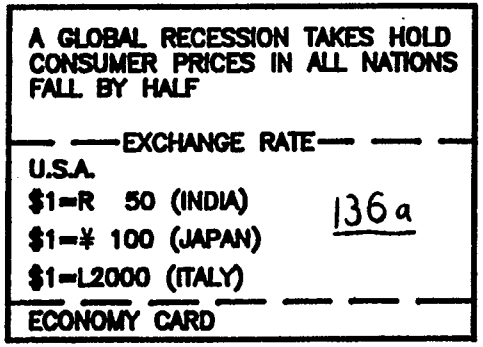
FIG. 18 is a view of the front or face of a typical "Economy" card used in the second embodiment of the present game, showing one of the instructions provided on such cards.

When a player lands on one of the economy positions **134*a* through 134*d*, an economy card must be drawn from the economy card space 136 of the board portion 100*b* and the instructions followed, as in the case of the game of the first embodiment discussed above. FIG. 18 discloses the front or face 138*a* of a typical economy card 138 for the second embodiment; these economy cards 138 are somewhat different than the cards 62 of the first embodiment, as they relate to a game encompassing four different nations and their currencies and variable exchange rates, as well as additional factors discussed further below. The economy cards 138 are shuffled and placed face down on the economy card space 136** at the beginning of the game, just as in the case of the game of the first embodiment discussed above, and are drawn as required during the course of play of the game. A listing of the contents of the economy cards used in the present game is shown following:

"GOOD TIMES" CARDS

Good times enable the Indian (or Japanese, U.S., or Italian, depending upon the card) Government to award you R50,000 (or Y100,000, US$1,000, or L2,000,000) for governing your cities well. You are also awarded any city and gasoline company you wish in India (or Japan, Italy, or the U.S.) which is available.

"FUEL TAX" CARDS

Japan (or the U.S., Italy or India, depending upon the card) imposes a high fuel tax. Air fares and gasoline prices double in Japan (or the U.S., Italy or India). Any "Star Card" drawn in Japan (or the U.S., Italy or India) pays twice the listed value.

"MIXED FINANCIAL" CARDS (1) A depression hits Japan and Italy, while India is hit by high inflation. The lira and yen double in value white the rupee loses half its value. Consumer prices in Italy and Japan drop by one half, while consumer prices in India double. Exchange rate is $1=R100, Y50, or L1000.

(2) Japan raises interest rates to slow the economy, while India and Italy lower their interest rates in order to stimulate their economies. The yen doubles in value while the rupee and lira lose half of their values. Consumer prices in all nations remain the same. Exchange rate is $1=R100, Y50, or L4000.

"INTERNATIONAL DEPRESSION" CARDS

A world wide depression causes consumer prices in all nations to decrease by one half. The exchange rate is $1=R50, Y100, or L2000.

"INTERNATIONAL INFLATION" CARDS

A global inflationary boom causes consumer prices in all nations to double. The exchange rate is $1=R50. Y100, or L2000.

"INFLATION" CARDS

Inflation hits the U.S. (or other nation). Consumer prices in the U.S. (or other nation) double. The dollar loses one half of its value. The exchange rate is $1=R25, Y50, or L1000 (depending upon the nation hit by inflation).

"HIGH INTEREST" CARDS

India and Japan raise interest rates to prevent high inflation, which makes the rupee and yen attractive to currency investors. Consumer prices in India and Japan remain the same. The rupee and yen double in value. Exchange rate is $1=R25, Y50, or L2000.

"RECESSION" CARDS

A recession takes hold in Italy and India; consumer prices in Italy and India fall by one half. The lira and rupee double in value. Exchange rate is $1=R25, Y100, or L1000.

"LOWER INTEREST" CARDS

Japan (or other nation) is in a mild recession. The Japanese government lowers interest rates in order to stimulate the economy, which is unattractive to currency investors. The yen loses one half of its value while the recession holds Japanese consumer prices constant. The exchange rate is $1=R50, Y200, or L2000.

The "good times" cards are exercised by the individual player drawing such a card as soon as the card is drawn and returned to the bottom of the deck as soon as it is drawn and exercised, as in the first embodiment. The remaining cards effect the economy of the game for all players and are turned face up on the top of the deck, as in the first embodiment. Drawing of a subsequent card causes the previous card to be returned to the bottom of the deck.

As a player continues along the game board playing path 106*a* from the U.S. border position 108*a*, he/she will land upon or pass over an "advance seven spaces" position 138*a* and an "advance one space" position 140*a*. (The equivalent positions 138*b* through 138*d* and 140*b* through 140*d* are respectively located along the playing path segments 106*b* through 106*d*, and produce equivalent results.) These positions 138*a* and 140*a* will be seen to cause a player to advance his/her,marker respectively to the departure side of the international airport 122*a*, or to the purchase price side of the city position 118*a;* the transactions resulting from such a player position have been discussed above. In addition to the positions 138 and 140 discussed above, additional "advance seven spaces" and "advance one space" positions, respectively indicated as 142*a* through 142*d* and 144*a* through 144*d*, are located farther along each of the respective playing path segments 106*a* through 106*d*. The second "advance seven spaces" position 142 will be seen to cause a player to advance his/her marker to the appropriate gasoline company 124; the financial transaction resulting has been discussed above. The second "advance one space" position 144 will cause the player to move to the purchase price side of the second city 118 of the respective segment 106, resulting in a transaction as has been discussed above.

In the event the player passes over the advance spaces 138 and 140, as well as the cities 118, he/she will next encounter a "Star" position 146*a;* the equivalents 146*b* through 146*d* are again located respectively along the playing path segments 106*b* through 106*d*. Two such positions 146 are located along each playing path segment 106. A star card space 148 is provided on the board portion 100*b*; star card rules are similar to those for the first embodiment.

Figure 19:
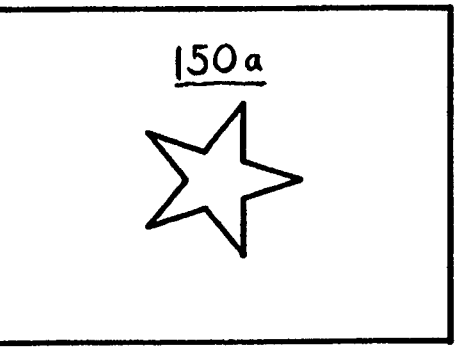
FIG. 19 is a view of the back of a "Star" card used in the second embodiment of the present game.

FIG. 19 discloses the back 150*a* of a star card 150, with the opposite face being similar to the star card face 68*b* of FIG. 6B. A listing of the star cards 150 used in the game of the second embodiment is shown below:

"SWEEPSTAKES" CARDS

Roll the dice and win 100 times the number rolled.

"PUSH YOUR LUCK" CARDS

Roll the dice: Total from 1 to 6=lose $600 (or equivalent). 7=no win or loss. Total of 8 to 12=win $600 (or equivalent).

"CLEANERS" CARDS

You've been "taken to the cleaners." Toss the dice and lose 50 times the number rolled.

"TRAVEL" CARDS (1) Go directly to Washington, D.C. (or other city which may be named on the card). Collect $250.

(2) Go directly to Rome, Italy (or other city which may be named on the card). Collect L500,000.

(3) Go directly to Bombay, India (or other city which may be named on the card). Collect R12,500.

(4) Go directly to Tokyo, Japan (or other city which may be named on the card). Collect Y25,000.

"AIRPORT" CARDS

Go to the nearest airport and pay double the normal air fare, for a round trip back to the departure point. Purchase the airport for twice the printed price if it is not owned by another player.

"GASOLINE COMPANY" CARDS

Go to the nearest gasoline company and pay twice the stated rate times the roll of the dice. Purchase the gasoline company for twice the printed price if it is not owned by another player.

"BORDER" CARDS

Advance to the nearest borderline and collect double the posted salary at that border.

"ECONOMY" POSITION CARDS

Move directly to the nearest Economy Card position and toss the dice. Collect $500 (or equivalent) for an odd total; lose $400 lot equivalent) for an odd total.

"DETENTION" CARDS

You have been arrested—go directly to the nearest detention center. Roll seven or eleven with the dice within three turns (maximum three attempts at each turn), or pay $100 fine (or equivalent, depending upon nation) for release.

"FINANCIAL" POSITION CARDS (1) Advance to the nearest Financial position. Buy or sell your "junk bonds." You receive $200 worth of junk bonds free.

(2) Advance to the nearest Financial position. Buy or sell stocks in the nation in which that Financial position is located. You receive 100 shares of that nation's stock free.

"STOCK" POSITION CARDS

Advance to the nearest Stock position. Buy or sell stocks in the nation in which that Stock position is located. You receive shares of that nation's stock free.

"BOND" POSITION CARDS

Advance to the nearest Bond position. Buy or sell junk bonds.

Preferably, a total of 27 of the star cards 150 are provided, which cards are exercised by the individual player drawing such a card as soon as the card is drawn and returned to the bottom of the deck as soon as it is drawn and exercised, in the manner of the star cards 68 discussed above for the game of the first embodiment. The star cards 150 may be divided into groups of five "Sweepstakes," "Push Your Luck," and/or "Cleaners" cards, four "travel" cards, two each "Airport," "Gasoline Company," and "Border" cards, two each "Economy" and "Financial" position cards, three each "Stock" and "Bond" position cards, and two "Detention" cards. Different numbers of the above cards may be provided.

The next playing position is a "Stock" position 152*a* through 152*d*, as indicated by the directional arrow 112 pointing toward each of the "stock" positions 152*a* through 152*d* respectively from the "star" positions 146*a* through 146*d*. Stock certificates 154a through 154*d* are provided for each nation of the game, as shown respectively in FIGS. 22A through 22D. The transactions of the game of the second embodiment are "international" in scope. When a player alights on a Stock position 152, that player may purchase or sell stock of any nation, and is not restricted to stock transactions using stocks of the specific nation in which that stock position 152 is located. However, stocks of any one specific nation must be purchased (from the bank or from another player) using currency from that nation. In other words, e.g., a player at the Italian stock position 152*b* may purchase Indian stock certificates 154*d*, but must use Indian rupees to pay for the transaction. Stock certificates may be provided in various denominations and are priced according to the specific finance card in effect; see further below for a discussion of finance cards.

Stocks generally pay a ten percent dividend to the owner thereof each time that player crosses a borderline to pass from one nation to another, but values may fluctuate depending upon the current "Financial Card" in play (see further below) at the time. A player may sell his/her stocks to another player at any time during the game, and/or may purchase stocks from another player at any time. However, if a player cannot find another player willing to enter into such a transaction, then the player wishing to make the stock transaction may only do so through the game bank, The game bank is not open for such transactions at all times, and the player wishing to make such a transaction must wait until he/she lands upon one of the Stock positions 152*a* through 152*d* before being allowed to make a stock deal through the bank. Again, stock certificates 154*a* through 154*d* of any nation may be traded from any stock position 152*a* through 152*d* on the board 100*a*/100*b*, so long as the appropriate national currency of the particular stock of the transaction is used for the exchange.

Figure 20A:
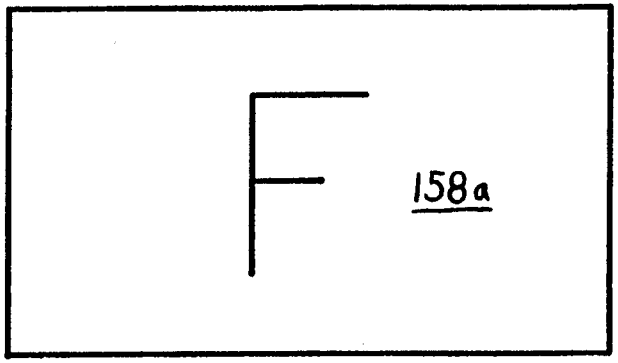
FIG. 20A is a view of the back of a "Financial" card used in the second embodiment of the present game.
Figure 20B:
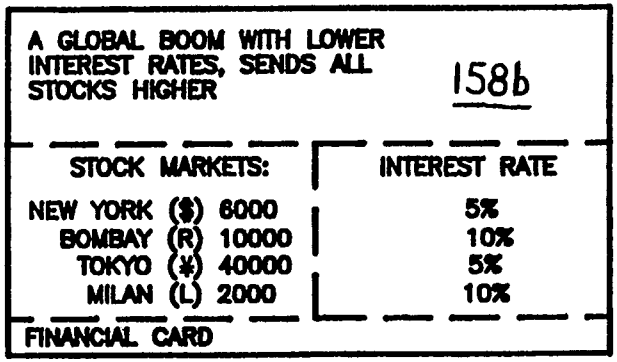
FIG. 20B is a view of the front or face of the "Financial" card of FIG. 20A, showing a typical financial situation.

After passing the Stock positions 150*a* through 150*d*, a player will advance respectively to and through the "International Airport" position(s) 122*a* through 122*d*; these positions and the transactions associated with them have been discussed above. In the second of the two spaces used for each airport position, an arrow will be seen which directs the path of play to the next position, i.e., the "Financial" positions 156*a* through 156*d* respectively adjacent each of the airports 122*a* through 122*d*. When a player alights on one of the Financial positions, a "Finance" card 158, as shown in FIGS. 20A and 20B: the back 158*a* of a typical Finance Card 158 is disclosed in FIG. 20A and the front or face 158*b* is disclosed in FIG. 20B.

Finance cards 158 generally operate similarly to the "Economy" cards 62 of the game of the first embodiment, discussed above, in that they generally effect financial matters for all players so long as they are in effect. Finance cards 158 are played (turned face up and placed on the top of the deck) whenever a player lands upon a finance playing position 156*a* through 156*d*, and the instructions on the front face 158*b* of that card 158 go into effect. Examples of the finance cards 158 and their effects upon stock prices and other financial situations are shown below:

(1) Standard stock prices and interest rates are in effect:

| Nation | Stock Prices/Share | Interest Rate |
|---|---|---|
| U.S.A. | $3,000 | 10% |
| Italy | L1,000 | 15% |
| India | R5,000 | 20% |
| Japan | Y20,000 | 10% |

(2) Most nations raise interest rates to prevent an inflationary boom; all stocks take a beating.

| Nation | Stock Prices/Share | Interest Rate |
|---|---|---|
| U.S.A. | $1,500 | 20% |
| Italy | L500 | 10% |
| India | R2,500 | 30% |
| Japan | Y10,000 | 15% |

(3) A recession hits all four nations. All nations lower their interest rates to spur investments, but markets are down. Junk bonds are in default; recover 354.

| Nation | Stock Prices/Share | Interest Rate |
|---|---|---|
| U.S.A. | $1,500 | 5% |
| Italy | L500 | 10% |
| India | R2,500 | 10% |
| Japan | Y10,000 | 10% |

(4) Japan and India lower interest rates in order to push investments, while the U.S. and Italy raise interest rates in order to cool off their economies. Junk bonds valued at 304.

| Nation | Stock Prices/Share | Interest Rate |
|---|---|---|
| U.S.A. | $1,500 | 20% |
| Italy | L500 | 25% |
| India | R10,000 | 10% |
| Japan | Y40,000 | 5% |

(5) Interest rates at par in all for nations keeps all stock markets at normal levels with the exception of the U.S.

| Nation | Stock Prices/Share | Interest Rate |
|---|---|---|
| U.S.A. | $6,000 | 10% |
| Italy | L1,000 | 10% |
| India | R5,000 | 10% |
| Japan | Y20,000 | 5% |

(6) The U.S. and India par their interest rates, while the Japanese have the lowest interest rates and Italy, the highest.

| Nation | Stock Prices/Share | Interest Rate |
|---|---|---|
| U.S.A. | $3,000 | 10% |
| Italy | L500 | 25% |
| India | R10,000 | 10% |
| Japan | Y40,000 | 5% |

(7) An economic boom takes place in all four nations. Most nations raise interest rates to slow their economies; stocks are all higher.

| Nation | Stock Prices/Share | Interest Rate |
|---|---|---|
| U.S.A. | $6,000 | 20% |
| Italy | L2,000 | 10% |
| India | R10,000 | 30% |
| Japan | Y40,000 | 15% |

(8) Stable interest rates keep stock markets performing well. Junk bonds pay off well, at 150% of purchase price.

| Nation | Stock Prices/Share | Interest Rate |
|---|---|---|
| U.S.A. | $6,000 | 10% |
| Italy | L2,000 | 15% |
| India | R10,000 | 20% |
| Japan | Y40,000 | 10% |

(9) Most investments make big money. Interest rates are steady, while most stock markets are in high gear. Junk bonds pay off at 125%.

| Nation | Stock Prices/Share | Interest Rate |
|---|---|---|
| U.S.A. | $6,000 | 10% |
| Italy | L2,000 | 15% |
| India | R10,000 | 10% |
| Japan | Y10,000 | 15% |

(10) Investments in the U.S. and Japan are "toasted" due to overexpectations. Investments in India and Italy rise as a result. Junk bonds default and pay off 25% of purchase price.

| Nation | Stock Prices/Share | Interest Rate |
|---|---|---|
| U.S.A. | $1,500 | 5% |
| Italy | L2,000 | 15% |
| India | R10,000 | 20% |
| Japan | Y10,000 | 5% |

Preferably, two of each of the above cards may be provided for a total of twenty Financial cards 158 for the game of the second embodiment. As in the case of other aspects of the present games, more or fewer cards with other variations may be provided. The deck of finance cards 158 is placed on the Finance Card space 159 on the board **100*b*** for play.

The above disclosed financial cards 158 provide for the variation of three different factors: Stock prices, interest rates, and junk bond payoffs. The stock prices are paid off according to the rules as discussed above and in accordance with the rates determined by whichever financial card 158 happens to be face up at the top of the deck at any given point in the game.

Interest rates will only affect a player who has borrowed money from the bank, using the various cities of which he/she has control and/or gasoline companies and/or airports which he/she owns for collateral. The maximum amount which a player may borrow is listed on each card for each city, gasoline company or airport. A player may borrow a maximum of US$1,200; L3,000,000; R90,000; or Y90,000. A player may borrow up to the maximum from up to two nations simultaneously.

The "junk bonds" are discussed further below, but essentially must be turned in at the time any finance card 158 with a junk bond instruction is turned up, with the payoff made according to the instructions (if any) on the finance card 158.

Continuing the advance along the playing path segment(s) **106*a* through 106*d*, a player will reach a "Lottery" position, respectively 160*a* through 160*d*. A player landing upon one of the lottery positions 160*a* through 160*d*, receives a minimum of $500 (for the lottery position 106*a* on the U.S. segment 106*a*), or a corresponding amount if he/she lands on one of the other lottery positions 106*b* through 106*d***, for "winning the lottery." Lottery winnings may be increased by $100 (or equivalent, depending upon the nation and currency) for "fines" paid to the detention centers, as described above for the game of the first embodiment.

Figure 21A:
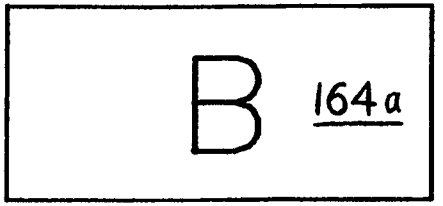
FIG. 21A is a view of the back of a "Bond" card used in the second embodiment of the present game.
Figure 21B:
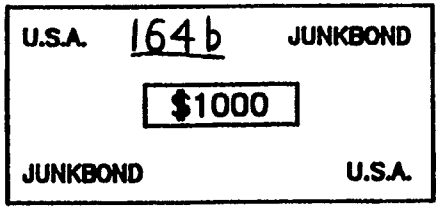
Figure 22A:
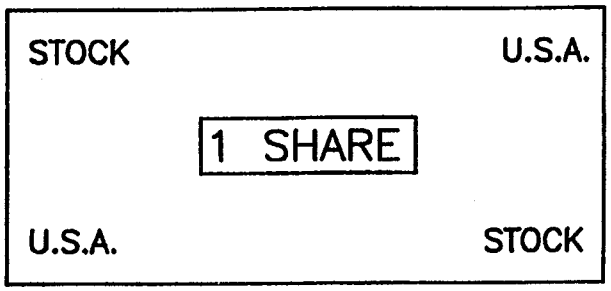
FIG. 22A is a view of the face of a simulated U.S. stock certificate used in the second embodiment of the present game.
Figure 22B:
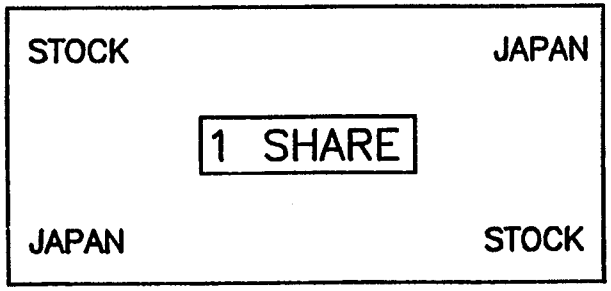
FIG. 22B is a view of the face of a simulated Japanese stock certificate used in the second embodiment of the present game.
Figure 22C:
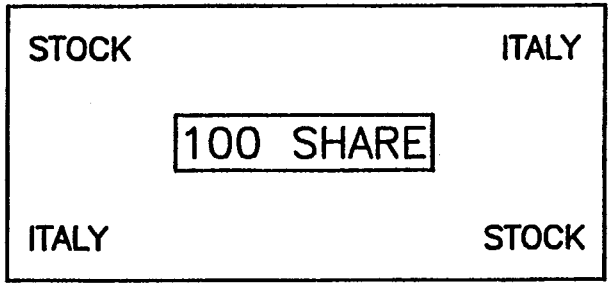
FIG. 22C is a view of the face of a simulated Italian stock certificate used in the second embodiment of the present game.
Figure 22D:
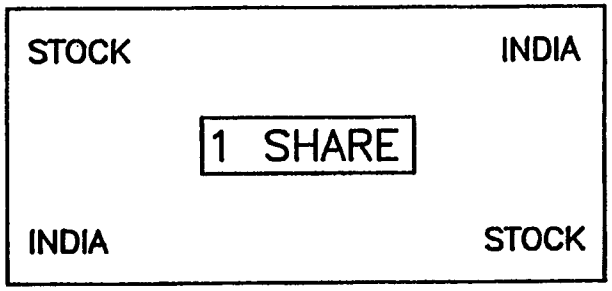
FIG. 22D is a view of the face of a simulated Indian stock certificate used in the second embodiment of the present game.

Continuing along the playing path segment(s) **106*a* through 106*d*, a player will encounter a "Bond" position 162*a* through 162*d*, respectively located along the segments 106*a* through 106*d*. When a player encounters one of the Bond positions 162*a* through 162*d*, he/she may purchase one or more bonds 164 (the rear 164*a* of which is shown in FIG. 21A and the front face 164*b* of which is shown in FIG. 21B), as desired. Junk bonds 164 may be provided in various denominations, and may be purchased using any currency, so long as the exchange rate is accounted for to provide an equitable transaction. While the stock certificates 154*a* through 154*d* have no definite maturity date and may be held as long as permitted by the rules i.e., the drawing of a card requiring the stocks 154 to be turned in), any bonds purchased have a definite maturity date, at which time they must be returned to the bank. Junk bonds 164 also provide a dividend to the holder thereof, each time the holder crosses one of the borderline positions 108 and collects his/her salary; at that time, the bank also pays a 20% dividend to bond holders. However, the bonds 164** "mature" after four such crossings, at which time they must be returned to the bank.

Junk bonds 164 may be freely traded among the players, as mutually arranged and desired. While normally the 20% income at each border crossing may be very desirable, bonds 164 may be sharply reduced in value at maturity, depending upon the particular finance card 158 which is in effect at bond maturity for that player. Thus, a player may gamble to a certain extent on the holding of a bond(s) 164 to maturity, or alternatively making some arrangement with another player to sell the bond 164. At maturity, the bank pays off the bond at face value (or reduced according to any relevant finance card 158 which may be in effect) in U.S. dollars; this is done at or immediately after crossing the fourth border after bond purchase, without requirement for landing upon a bond position 162. However, purchase of a bond(s) by a player may only be done when that player lands upon a bond position 162.

Finally, continuation of travel along the generally peripheral playing path segments 106*a* through 106*d* of the board 100*a*/100*b* will eventually lead a player to one of the "Detention Center" positions 166*a* through 166*d*. A player alighting upon such a detention center position 166*a* through 166*d* incurs no penalty if such move is made in the normal course of advancement of that player's marker 110 along the playing path 106*a* through 106*d*; the player may accordingly position his/her marker 110 in the "visiting" area of the detention position 166*a* through 166*d* and continue to play and advance in turn according to the normal rules of play, as in the case of the game of the first embodiment discussed above. However, penalties are incurred for a player who is required to remain in the detention area, as will be described following.

It will be noted that the playing path 106 of the game board 100*a*/100*b* has no direct provision to cause a player to move to a detention position and be held there, as in the case of the game of the first embodiment. However, one or more of the Star cards 150 may instruct a person drawing such a card to go directly to the nearest detention center (without crossing a borderline) and remain there until he/she is able to be freed. The tossing of two consecutive sets of doubles (with the first set being six or less) with the dice 26 also requires the player to be detained within one of the detention center positions 166. The player so detained must toss a total of seven or eleven on the dice 26 in order to be released (rather than the doubles required in the game of the first embodiment); three opportunities each turn for three turns are provided. If after the nine tries the player is still unsuccessful, then he/she must pay a $100 fine to the lottery account, for potential future collection by any player landing on one of the lottery positions 160*a* through 160*d*.

Play continues in the above manner, with the players continuing to travel generally clockwise about the generally peripheral playing path segments 106*a* through 106*d* and the folded extensions thereof of the board 100*a*/100*b*, generally in the manner of the game of the first embodiment discussed above. Players will continue to accrue (or lose) wealth in the form of U.S. dollars, Italian lire, Indian rupees, Japanese yen, cities, tax tokens, and stocks and bonds during the course of play, with at least some of the players eventually losing all of their wealth and becoming "bankrupt." Those bankrupt players are no longer allowed to play, and are out of the game.

The Game may be played until only one player remains, or alternatively may be played to a time limit, as the relatively complex rules and changing exchange rates will be seen to provide a game which may be of quite lengthy duration. In some cases, the "bank" may become insolvent, whereupon those players remaining in the game audit their wealth, with the "richest" player being the winner; the above possibilities will be seen to be essentially the same as those of the game of the first embodiment.

As in the case of the game of the first embodiment discussed above, there will be relatively few occurrences where any given player gains control of both of the cities of a single nation, and is thus able to charge the maximum tax possible to others landing on either of those cities. Accordingly, players may wish to trade control of the various city positions in order to be able to optimize the taxes charged to other players. As all of the cities of the various playing path segments 106*a* through 106*d* have identical values and tax structures (even though they may be of different colors for ease of identification), the only applicable type of trade is the "Perfect Trade" discussed in the disclosure of the game of the first embodiment, although in the case of the game of the second embodiment only a single city will be passed from one player to another, as each player may hold a maximum of only two cities of a given nation due to the construction of "the game board 100*a*/100*b*. No other consideration or properties need be exchanged in such a trade. Such trades will be seen to accelerate the progress of the game, as may be desirable from time to time.

If desired, simplification of the game of the second embodiment may be provided by disregarding the stocks and/or bonds, financial cards, and economy cards, as desired. Playing positions which are associated with such features of the game may be treated as "free" spaces, in which no action is required of a player landing thereon, as was described for the simplification of the game of the first embodiment. The various exchange rates will be seen to be generalized, in order to allow relatively easy and rapid calculation in a player's head. Other means of shortening and/or simplifying the above game may be used if desired, such as some of those used in the simplification of the game of the first embodiment, e.g., shuffling and dealing the city cards in order to shorten the number of laps of the playing path 106 required to acquire control of those cities, etc. Players must then pay the bank for control of the cities, in accordance with standard rules, as in the game of the first embodiment. The game and play thereof may then commence according to the standard rules of play, described further above. A time limit may be set for the end of the game, with the player acquiring the greatest wealth being the winner.

The above game embodiments will be seen to provide relatively complex games of international finance, which are capable of providing significant education for the players thereof. Alternatively, the games may be simplified for initial instruction and/or for younger players, etc. The use of variable exchange rates between two or more currencies will be seen to be of particular value to players wishing to learn more about international finance in an entertaining and enjoyable way.

It is to be understood that the present invention is not limited to the sole embodiments described above, but encompasses any and all embodiments within the scope of the following claims.

I claim:

1. A board game apparatus of international finance comprising:

at least one game board having a first playing path and an adjacent second playing path, and providing for play over both of said playing paths during the course of play of said game;

said first playing path and said second playing path of said game board each forming a closed loop and each containing an area therein providing for the storage of cards used in the course of play of said game;

said first playing path of said game board comprising a plurality of consecutive playing spaces simulating municipalities, corporations, and other features of a first nation, and said second playing path of said game board comprising a plurality of consecutive playing spaces simulating municipalities, corporations, and other features of a second nation;

a plurality of player position markers each of a different color, and chance means providing for the determination of each move of each of said player position markers during the course of play of said game;

a first plurality of tokens and a second plurality of tokens, said tokens respectively representing standard and maximum taxes applicable to players of said game;

a first currency in different denominations simulating the currency of said first nation, and a second currency in different denominations simulating the currency of said second nation, with said first currency and said second currency having different values from one another;

a plurality of transaction cards corresponding to said playing spaces simulating municipalities, corporations, and other features of said first nation, and said playing spaces simulating municipalities, corporations, and other features of a second nation, and;

a first plurality of cards providing for the random determination of exchange rates between said first currency and said second currency, and a second plurality of cards providing for random financial rewards and penalties for players, whereby;

players proceed in turns about said first playing path and said second playing path by means of said player position markers and perform simulated financial transactions and currency exchanges according to the rules of said game, with the winner of said game being determined by the player accumulating the greatest simulated wealth after a predetermined period of play.

2. The board game apparatus of claim 1 wherein:

said first playing path is disposed peripherally on a first game board and said second playing path is disposed peripherally on a second game board, with each said playing path having means providing for movement from one said playing path to another said playing path and said first game board and said second game board being placed adjacent to one another for play of said game.

3. A board game apparatus of international finance comprising:

a game board having a central area containing first, second, third, and fourth quadrants and a peripheral playing path therearound, with said quadrants each representing a different nation and said playing path having four segments thereon representing financial transactions according to said different nation of each of said quadrants;

said game board further containing an area therein providing for the storage of cards used in the course of play of said game;

said playing path of said game board comprising a plurality of consecutive playing spaces simulating municipalities, corporations, and other features of each said different nation;

a plurality of player position markers each of a different color, and chance means providing for the determination of each move of each of said player position markers during the course of play of said game;

a first plurality of tokens and a second plurality of tokens, said tokens respectively representing standard and maximum taxes applicable to players of said game;

currencies in different denominations simulating the currency of each said different nation, with said currencies having different values from one another;

a plurality of transaction cards corresponding to said playing spaces simulating municipalities, corporations, and other features of each said different nation, and;

a first plurality of cards providing for the random determination of exchange rates between said currencies, and a second plurality of cards providing for random financial rewards and penalties for players, whereby;

players proceed in turns about said playing path by means of said player position markers and perform simulated financial transactions and currency exchanges according to the rules of said game, with the winner of said game being determined by the player accumulating the greatest simulated wealth after a predetermined period of play.

4. The board game apparatus of claim 3 wherein:

said playing path includes four additional extensions each having additional playing spaces thereon and providing for the elongation of said playing path.

5. The board game apparatus of claim 4 wherein:

said extensions are folded alongside said playing path.

6. The board game apparatus of claim 3 including:

a plurality of stock shares representing stocks of each said nation and providing for simulated stock transactions in each said different nation of said game.

7. The board game apparatus of claim 3 including:

a plurality of bonds providing for simulated bond transactions during the course of play of said game.

8. The board game apparatus of claim 7 wherein:

said bonds represent only a single nation and provide for simulated bond transactions in only one of said currencies of said game.

* * * * *